US007290749B1

(12) United States Patent
Jessop et al.

(10) Patent No.: US 7,290,749 B1
(45) Date of Patent: Nov. 6, 2007

(54) CONCRETE FORM SYSTEMS WITH CONCRETE TIES

(75) Inventors: L. Alma Jessop, Herriman, UT (US); Derrel L. Spencer, Lehi, UT (US)

(73) Assignee: Cactus Holdings, LLC, Lehi, UT (US)

( * ) Notice: Subject to any disclaimer, the term of this patent is extended or adjusted under 35 U.S.C. 154(b) by 0 days.

(21) Appl. No.: 10/886,158

(22) Filed: Jul. 7, 2004

Related U.S. Application Data

(60) Provisional application No. 60/544,698, filed on Feb. 13, 2004.

(51) Int. Cl.
*E04G 11/08* (2006.01)

(52) U.S. Cl. ..... 249/34; 249/5; 249/6

(58) Field of Classification Search ..... 249/34, 249/3, 4, 5, 6, 9, 208, 213, 218, 47, 191, 249/192, 196
See application file for complete search history.

(56) References Cited

U.S. PATENT DOCUMENTS 1,202,269 A * 10/1916 Cramer ..... 249/6
1,212,654 A 1/1917 McKay
1,235,542 A * 8/1917 Bagby ..... 249/47
1,496,933 A * 6/1924 Heltzel ..... 249/4
1,523,961 A * 1/1925 Heltzel ..... 249/6
1,548,038 A * 8/1925 Hotchkiss ..... 249/6
1,644,588 A * 10/1927 Heltzel ..... 249/9
1,754,638 A 4/1930 Mead
2,046,123 A * 6/1936 Allen ..... 249/191
2,849,790 A * 9/1958 Hillberg ..... 249/191
2,887,756 A * 5/1959 Brechel ..... 249/6
3,429,547 A * 2/1969 Schimmel ..... 249/47
3,648,962 A 3/1972 Farley
3,712,576 A 1/1973 Dagiel
4,121,804 A * 10/1978 O'Leary ..... 249/6
4,320,888 A * 3/1982 Oury ..... 249/191
4,442,644 A 4/1984 Jukes
4,451,022 A * 5/1984 Sauger ..... 249/4
4,545,163 A 10/1985 Asselin
4,579,312 A * 4/1986 White ..... 249/6
4,659,054 A * 4/1987 Allen ..... 249/7
4,750,703 A * 6/1988 Gentilcore et al. ..... 249/6
4,846,437 A 7/1989 Fitzgerald
5,076,536 A 12/1991 Fitzgerald
5,096,155 A 3/1992 Fitzgerald
5,205,942 A 4/1993 Fitzgerald
5,207,931 A * 5/1993 Porter ..... 249/213
5,240,224 A 8/1993 Adams
5,261,635 A * 11/1993 Flathau ..... 249/7

(Continued)

*Primary Examiner*—Michael Safavi
(74) *Attorney, Agent, or Firm*—Morriss O'Bryant Compagni

(57) ABSTRACT

A system for holding poured concrete in a desired shape until it sets is disclosed. The system can include a plurality of forms having two opposing end sections. Each of the end sections has an end bracket attached to it. A plurality of footing stakes are used to connect the end brackets together such that the forms maintain the desired shape. At least one whaler bracket is secured to a top of the forms to maintain the spacing between them. A skin panel can be used to bridge gaps between forms. Bulkhead brackets can be attached to the ends of the forms and secured to allow end walls to be created where desired. Vertical footing panels can also be used to pour concrete onto adjoining inclined surfaces.

7 Claims, 11 Drawing Sheets

U.S. PATENT DOCUMENTS 5,332,191 A * 7/1994 Nolan ..... 249/1
5,535,565 A 7/1996 Majnaric et al.
5,562,272 A 10/1996 McAbee et al.
5,616,271 A 4/1997 Podgurski
5,651,910 A * 7/1997 Myers et al. ..... 249/191
5,833,872 A 11/1998 De Le fevre
5,861,105 A 1/1999 Martineau
5,997,792 A 12/1999 Gordon
6,021,994 A 2/2000 Shartzer, Jr.
6,164,615 A 12/2000 Basham
6,175,462 B1 1/2001 Chung et al.
6,250,033 B1 6/2001 Zelinsky
6,322,047 B1 11/2001 Holmboe, Jr.
6,550,213 B1 * 4/2003 Butler ..... 249/47
6,568,651 B2 5/2003 Reid
6,742,758 B2 * 6/2004 Janesky ..... 249/7
2004/0094689 A1 * 5/2004 Rose ..... 249/6

* cited by examiner

CONCRETE FORM SYSTEMS WITH CONCRETE TIES

RELATED APPLICATIONS

This application claims the benefit of and priority to U.S. Provisional Patent Application Ser. No. 60/544,698, filed Feb. 13, 2004, and entitled "Concrete Form Systems with Concrete Ties", the disclosure of which is incorporated herein by this reference.

BACKGROUND OF THE INVENTION

1. Field of the Invention

The present invention generally relates to concrete form systems, and, more specifically, to concrete form systems with modular components that can be used to construct various types, sites, and shapes of concrete structures, such as concrete footings.

2. Description of Related Technology

Concrete footings are routinely poured all over the world. These footings provide a solid, secure base on which to build walls or other structures. In the United States, concrete footings are poured for nearly every new home or office building at points where the weight of the building rests. For new homes, footings are generally poured around the perimeter of the building to provide support for the foundation walls, as well as inside the perimeter to support structural columns or posts.

In the post, conventional concrete footings were often constructed by nailing together plywood or other materials into a form with a desired shape and pouring the concrete into the space created by the plywood. After the concrete is cured, the plywood is separated from the concrete, typically using a hammer. This often results in cracking and splintering of the plywood, thus making the plywood unusable for creating new footings. This not only wastes material, but can be a safety hazard because splintered wood can cause injury.

Some existing systems have attempted to overcome these drawbacks. For example, one system can include numerous panels with complex grooves or channels connected to the ends of each panel. The channels are designed to allow adjacent panels to interlock, which allows a form to be constructed. This known system requires that complex shaped inserts be placed within the channels to connect the panels. In particular, a first insert could be used to fix adjacent panels into a generally parallel configuration. Another type of insert may be used to fix adjacent panels into a perpendicular configuration.

Unfortunately, this known system also has several drawbacks. For example, the channels are difficult to manufacture because they have a complex structure. In addition, due to the complex structure of the channels, mud or other debris can easily clog the channel, which makes it difficult or impossible to use the inserts. Further, if channels in adjacent forms are not precisely aligned, the inserts can be difficult or impossible to use.

Additionally, because the panels have a predetermined length, it is difficult to design a footing system with the exact dimensions that a user would want. Accordingly, it may be necessary to modify one or more panels to create a form with the desired size and configuration. This undesirably increases the time and cost required to construct the footing.

Finally, this conventional system requires the use of multiple different inserts to enable a user to place the panels at different angular orientations. Thus, it is necessary to identify the inserts needed prior to creating the form. Additionally, any changes in the design of the form require additional time while more panels and/or inserts are obtained, which also increases the costs.

BRIEF SUMMARY OF THE INVENTION

A need therefore exists for a concrete system that eliminates the above-mentioned disadvantages and problems. The present invention is generally directed towards a system that allows concrete structures, such as a concrete footing, to be constructed. Advantageously, the system may facilitate quick and easy assembly of one or more forms to define a space that receives concrete or another material to create the desired structure. The system may be designed so that two or more forms may be easily joined together using simple components that allow the relative position of adjacent forms to be quickly and easily changed using the same components.

One aspect is a system that may include a number of different forms having a two piece construction, with each form having a channel that extends at least partially along the longitudinal length of the form. This channel accommodates a tie that may extend between spaced apart forms. The ties maintain a uniform distance between the spaced apart forms so that concrete or other material poured between the forms has at least one uniform dimension along the form's length.

Another aspect is a system that may include a number of different types of forms with each form including a bracket and/or an end cap attached to each of the opposing ends of the form. The brackets desirably enable the relative position of adjacent forms to be fixed in a desired position.

Yet another aspect is a system that may include a number of forms of varying lengths. In particular, the forms may have different lengths and include one of two types of bracket attached to opposing ends of the form. One form can include a bulkhead bracket and can be a bulkhead form. This bulkhead form can be attached to another form at a suitable location, such as the brackets attached to the ends of the form or at any desired location along a length of the form. This allows the length of a form to be easily and simply changed to accommodate for different footing or structure configurations.

Still another aspect is a system that may use a skin panel to bridge a gap between forms. Advantageously this allows the length or size of the concrete structure to be expanded and/or extended. In addition, when brackets of adjacent forms do not align, the skin panel may bridge the gap between the separated forms. Using the skin panel, footings or structures of any length can be laid out, even when using forms of fixed length. Desirably, the skin panel fits over the top of the adjacent forms. The skin panel may also have holes in the top to accommodate one or more stakes, which can be inserted through the skin panel and the holes in the brackets attached to the ends of the form.

Yet another aspect is a system that allows the forms to be reused. Advantageously, this eliminates much of the waste associated with conventional forms and systems.

Advantageously, the system may include various types of forms that link together in an easily modifiable manner to accommodate for changes in the layout of a footing or other structure. In particular, the system may simply and easily define a space that receives concrete or another material. This allows structures, such as footings or other structures to be quickly and efficiently created.

In one embodiment, the system can include one or more forms. Each form includes a panel with end brackets and/or end caps mounted or attached to opposing ends of the panel. One panel can have a two-piece construction, with the panel having an upper member and a lower member. These members are separated to create a channel extending at least partially along the longitudinal length of the panel. This channel receives one or more ties that separate spaced-apart forms in a uniform manner. Another panel can have a single member, with the optional ties attached to an upper portion thereof.

Each end bracket enables adjacent forms to be mounted together at numerous angular orientations. The end bracket includes a protrusion that may be disposed within a lumen of the panel, such as either the upper member or the lower member. Alternatively, the form includes an end bracket mounted within a lumen of each of the upper member and the lower member.

In still another configuration, the form includes an end bracket having two sub-brackets, one mountable in one lumen of the upper member and one mountable in one lumen of the lower member. The opposite end of the end bracket includes a hole that can receive a stake or other structure that limits movement of one form relative to an adjacent form when disposed in the holes of adjacent forms. By selectively placing one form with an end bracket in the upper member, and an adjacent form with an end bracket in a lower member, the forms can be joined together by inserting a stake through the two aligned holes in the end brackets. This enables a user to join the forms at almost any angle since each form can rotate about an axis defined by the holes in the tubular portions receiving the stake.

While the end brackets of adjacent forms facilitate attachment of the forms, the end cap prevents debris from entering into the interior of either the upper member or the lower member. This end cap can include a generally planar member and a protrusion extending from the planar member. The planar member also provides a surface upon which, in some embodiments, a portion of the end bracket of an adjacent form may move.

In another embodiment, the system can include a form that includes a panel with one or more bulkhead brackets mounted or attached to the ends of the panel. The bulkhead bracket can include two end caps, each having a protrusion that may be disposed within an interior lumen of the panel. The bulkhead brackets can include two flanges that extend from a top and bottom of the panel sufficiently to allow the flanges to protrude over the top and under the bottom of the panel of another form. The bulkhead form can be located at any position along the length of other forms that uses the end caps and flanges, which allows a length of a footing or other structure to be changed by simply moving the location of the bulkhead form. Thus, the length of the footing or other structure is not limited by the length of the forms. In addition, the flanges may also have holes to accommodate stakes to allow the bulkhead form to be secured in a desired location. The bulkhead bracket can also be configured to mount to a panel having a single member, such that a single end cap mounts to one end of the panel.

In another embodiment, the system can include one or more forms. Each form includes a panel with end brackets mounted or attached to opposing ends of the panel. The panel can have a unitary construction and be substantially tubular. Each end bracket has a protrusion that extends out from the end of the panel. The protrusions can have a height that is slightly less than half the height of the panel. In exemplary embodiments, the protrusions are joined in an opposing configuration to opposite ends of the panel, such that one protrusion is located towards a top of the panel, while the opposite protrusion is located towards the bottom. This allows adjacent panels to be easily joined together to form a system of any desired configuration. This system is especially useful in facilitating the pouring of large, flat areas of concrete, such as a patio or sidewalk. The configurations of bulkhead forms and associated end brackets can be modified accordingly to cooperate with these panels.

The exemplary systems may also allow concrete or other material to be poured on an inclined surface. In particular, the concrete or other material can be poured on an upwardly or downwardly sloping surface. For example, the system may include a pair of vertical forms to aid with accomplishing this task. The pair of vertical forms can be fixed on a top surface of the forms and joined together to hold the poured concrete against the inclined surface. The vertical forms may each have two sides that are joined at an approximately 90-degree angle. One of the two sides of each of the pairs of the vertical forms may be desirably connected together to form a channel with the inclined surface forming the fourth side. This allows for the pouring of concrete footers and other structures at varying angles and inclined surfaces.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EXEMPLARY EMBODIMENTS

Figure 1:
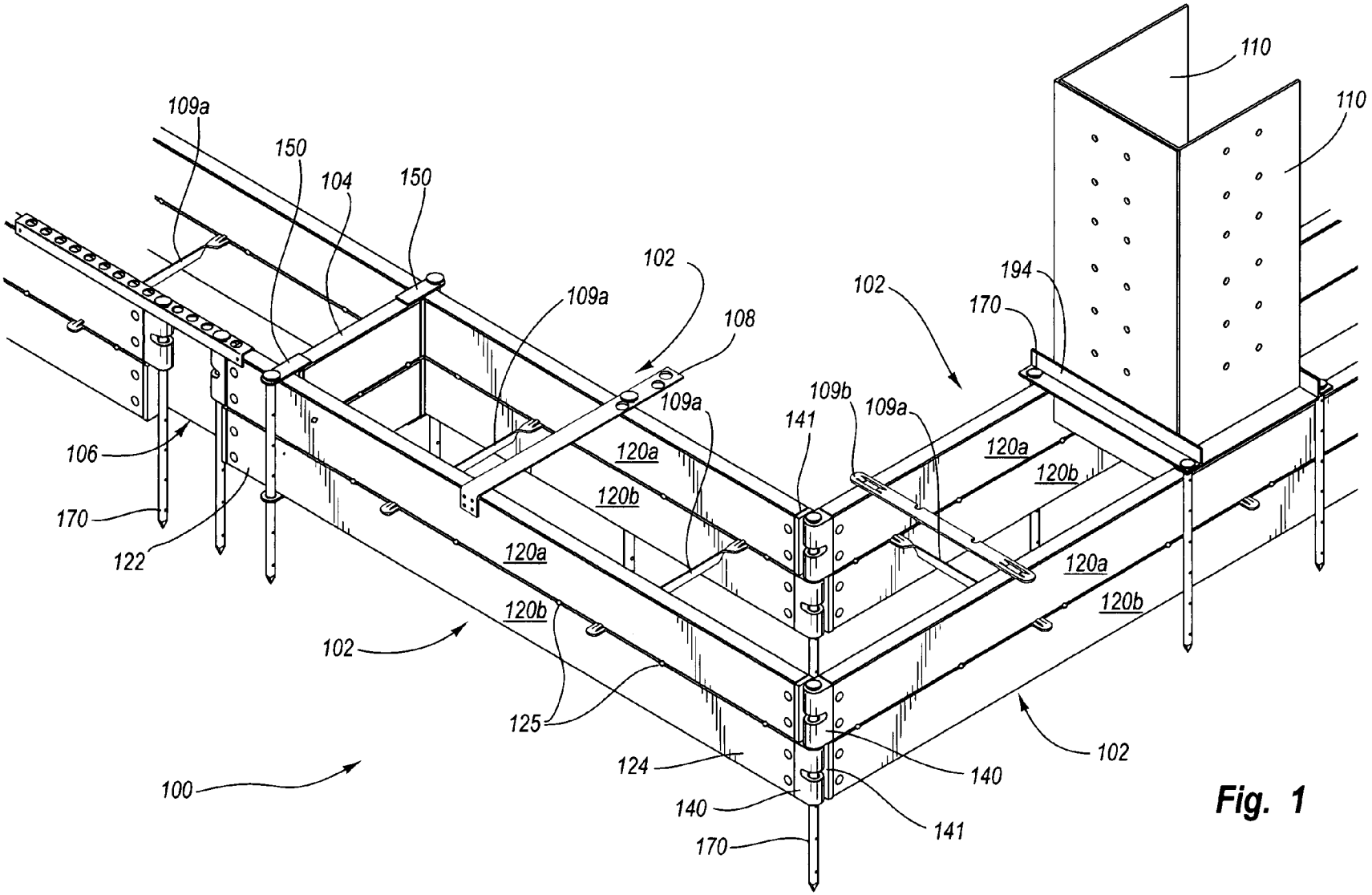
FIG. 1 is a perspective view of an exemplary embodiment of a system used to construct a footing.

The present invention is a system used to create concrete footings or other structures. One exemplary embodiment of an exemplary system is shown in FIG. 1, and designated generally as reference numeral 100. This system 100 enables forms for footings or other structures to be positioned in a simple and efficient manner, and to any desired dimensions, while limiting waste of wood or other materials. The system 100 can include various forms, brackets, and panels that are used together to accommodate variations in layout and configuration.

The system 100 generally can include a number of forms, shown generally as reference numerals 102 and 104. As mentioned above, a form is a structure that aids with defining a space within which concrete or other material is to be received. One or more forms 102, 104 are used to create a structured layout of the space to receive the concrete or other material. In the exemplary system 100, various types or kinds of forms are provided, each of which performs different functions and connects to other forms in a different manner. The system 100 facilitates simple joining of forms using simple components that allow the relative position of adjacent forms to be quickly and easily changed.

With reference to FIG. 1, system 100 can include a form 102 and a form 104. Each form 102, 104 may include a panel 120 with one or more brackets 140 and/or end caps 141 attached to each opposing end of the panel 120. The brackets 140 and end caps 141 can be selected based upon the function to be performed by the form 102, 104. A general purpose form, such as the form 102, can include an end bracket 140 and an end cap 141. In contrast, a bulkhead form 104 may include bulkhead brackets 150. The bulkhead form 104 can be used to ensure that the space defined by system 100 has a uniform width, while creating a layout termination surface. The system 100 may optionally include a whaler bracket 108 that acts as a brace between two spaced apart forms 102, while maintaining a desired separation between the forms 102. The system 100 may also include one or more ties 109*a* and/or 109*b* that extend between spaced apart forms 102.

When using the system 100 to create a space to receive concrete or other material, a lengthwise gap may be left between two adjacent forms 102. This may occur when the end brackets 140 of two adjacent forms 102 do not align. To bridge this gap, the system 100 can include a skin panel 106. The skin panel 106 can accommodate various lengths of gap. Therefore, using skin panel 106, footings or structures of any length can be laid out, even when using forms of fixed length.

The exemplary embodiments will be described in the context of using the system 100 for creating a concrete footing for a building structure. It will be understood, however, that the exemplary embodiments can be used with other structures. Generally, the system 100 is modular and can include a variety of forms, panels, brackets and end caps that can cooperate to define a desired space that receives concrete or other material.

Figure 2B:
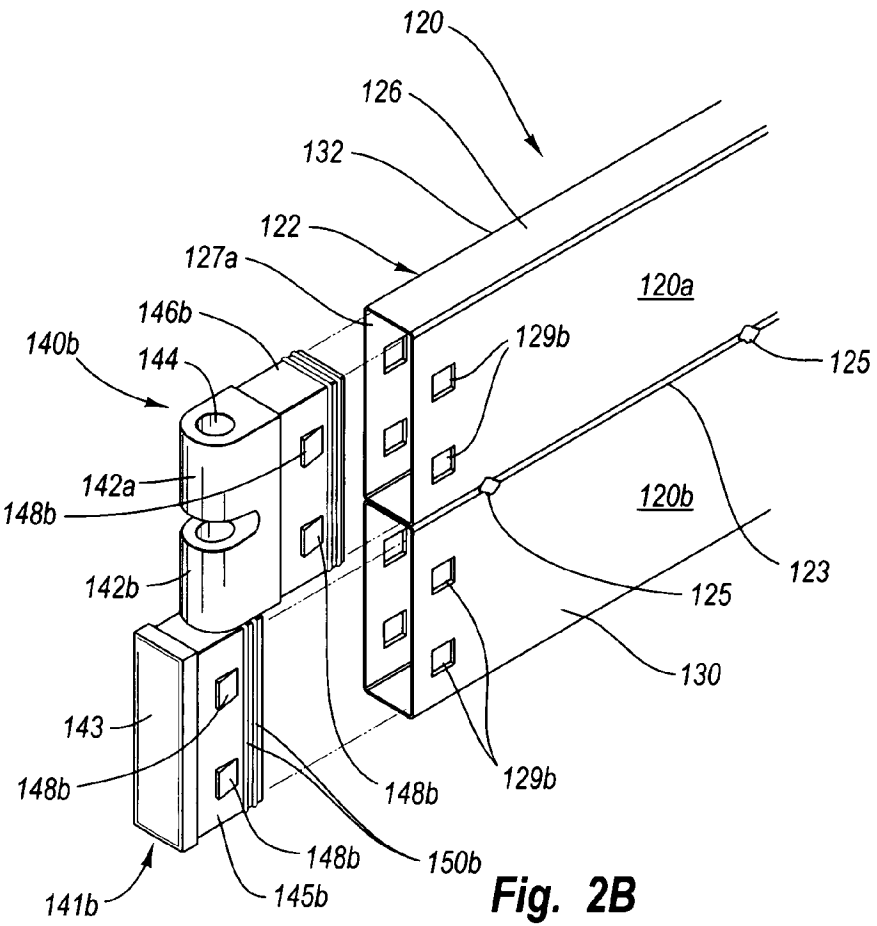
FIG. 2B is a perspective view of a portion of the system shown in FIG. 1, illustrating an alternate configuration of an end bracket and an end cap.
Figure 2A:
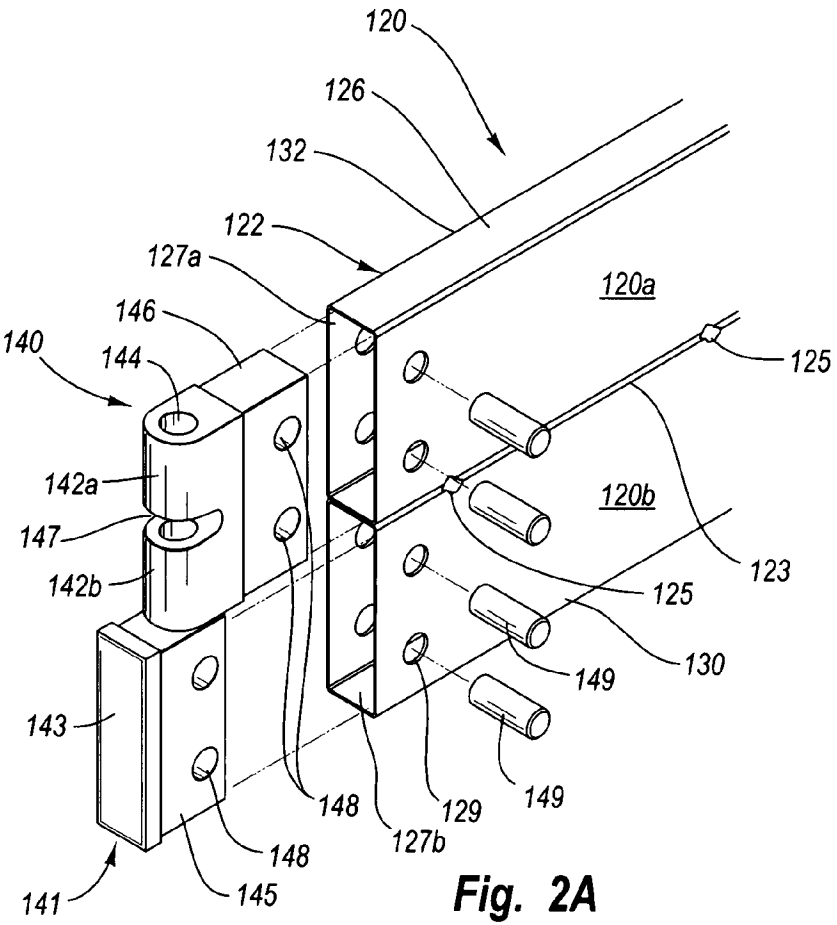
FIG. 2A is a perspective view of a portion of the system shown in FIG. 1, illustrating an end bracket and an end cap.

With reference to FIG. 2A, the form 102 may include the panel 120 with one or more end brackets 140 attached to opposing ends of the form 102. FIG. 2A only illustrates one end bracket 140. In other configurations, the form 102 can include multiple end brackets 140. The panel 120 may be generally planar and have sufficient rigidity to hold concrete or other materials in place before it cures or sets. In the illustrated configuration, the panel 120 has a proximal end 122 and a distal end 124 (FIG. 1), each of which can receive the end bracket 140. As shown, the panel 120 includes an upper member 120*a* and a lower member 120*b* that are separated to form a channel 123. The upper member 120*a* and the lower member 120*b* can be tubular members or alternatively can be substantially solid members that have a recess or cavity at one or more of the ends 122, 124 thereof. These upper and lower members 120*d* and 120*b* are joined together at periodic or sporadic locations along their longitudinal lengths. For instance, the members 120*a* and 120*b* can be welded together so that welds 125 both join the members 120*a* and 120*b* and separate the members 120*a* and 120*b*. Other mechanical fasteners or structures can be used to join and separate members 120*a* and 120*b*.

The channel 123 formed between members 120*a* and 120*b* may optionally extend along the entire or substantially the entire length of the upper member 120*a* and the lower member 120*b*. This channel 123 can receive one or more ties 109 as will be described in more detail hereinafter.

Extending between the proximal end 122 and the distal end 124 (FIG. 1) of the panel 120 is a top surface 126 associated with the upper member 120*a*, a bottom surface 128 associated with the lower member 120*b*, an inside surface 130 defined by the inside surfaces of both the upper member 120*a* and the lower member 120*b*, and an outside surface 132 defined by the outside surfaces of both the upper member 120*a* and the lower member 120*b*. These terms are specific to the orientation of form 102 illustrated in FIGS. 2A-2C. It will be understood that if the form 102 is inverted, the top surface 126 may not be the "top surface", the bottom surface 128 may not be the "bottom surface", the inside surface 130 may be not the "inside surface", and the outside surface 132 may not be the "outside surface". The exemplary embodiments should not be considered limited by the use of these relative terms.

In one exemplary embodiment, each of the upper member 120*a* and the lower member 120*b* of the panel 120 is an aluminum tubular member. Disposed at least one of the ends 122 and 124 of each member 120*a* and 120*b* are one or more holes 129. These holes 129 aid in attaching the end bracket 140 to the upper member 120*a*.

Although reference is made to the upper member 120*a* and the lower member 120*b* being aluminum tubular members, each of the upper member 120*a* and the lower member 120*b* can be a wooden board, although other materials are possible, such as plywood, plastic, pressboard, metal, alloy, high density overlaid (HDO) wood, composites, or any other material having the desired rigidity and strength, whether or not such materials are used to form a tubular structure. When the upper member 120*a* and the lower member 120*b* are not tubular members, they may include a recess or cavity that cooperates with the end bracket 140.

Additionally, each panel 120 can be fabricated from one or more sections that connect together to create the desired structure of panel 120. The panels 120 can have various cross-sectional areas or dimensions. In one configuration, the panel 120 has cross-sectional dimensions of about two inches by about twelve inches. In another configuration, the panel 120 can have cross-sectional dimensions of one and one eighth inches by eleven and one eighth inches, one and one quarter inches by eleven and seven eighth inches, or other cross-sectional dimensions depending on the type of material used to make panels 120. Similarly, each panel 120 can have various lengths, such as but not limited to, from about one foot to about twelve feet in length. It will be understood that lengths lesser than one foot and greater than twelve feet are also possible.

As shown in FIG. 2A, the end bracket 140 may mount to the end 122 and be received within an interior lumen 127*a* of the upper member 120*a*. Alternatively, the end bracket 140 can be disposed within a lumen 127*b* of the lower member 120*b*. In still another configuration, the end bracket 140 can be disposed in both lumens 127*a* and 127*b*. In still another configuration, the end bracket 140 can include a flange that mounts to one or more of the top surface 126 associated with the upper member 120*a*, the bottom surface 128 associated with the lower member 120*b*, the inside surface 130 defined by the inside surfaces of both the upper member 120*a* and the lower member 120*b*, and/or the outside surface 132 defined by the outside surfaces of both the upper member 120*a* and the lower member 120*b*.

As shown, the end bracket 140 includes an upper portion 142*a* and a lower portion 142*b*, each having an opening 144 extending therethrough. A protrusion 146 extends from the tubular portions 142*a* and 142*b*. This protrusion 146 cooperates with the inner lumen 127*a* of the upper member 120*a*. Passing through this protrusion 146 are one or more apertures 148. Each of the apertures 148 can receive a fastener 149, such as a rod, that passes through one of the holes 129 in the upper member 120*a* and an aperture 148 in the protrusion 146 when the protrusion 146 is disposed within the inner lumen 127*a*. This fastener 149 can interference fit with one or both of the upper member 120*a* and the protrusion 146 of the end bracket 140. By so doing, the fastener 149 securely retains the end bracket 140 to the upper member 120*a*.

Although reference is made to the fasteners 149 interference fitting with one or both of the upper member 120*a* and the protrusion 146 of the end bracket 140, one skilled in the art will understand that various other techniques may be used to attach the end bracket 140 to the panel 120. For instance, in another configuration, fastener 149 can thermally bond to one or both of the upper member 120*a* and the protrusion 146 of the end bracket 140.

Various other manners are known to attach the end bracket 140 to the panel 120. With reference to FIG. 2B, illustrated is another alternate configuration of the end bracket, identified by reference numeral 140*b*. The discussion of the end bracket 140 also applies to the end bracket 140*b*. Consequently, like structures are identified with like reference numerals.

As shown, the upper portion 142*a* and the lower portion 142*b* of the end bracket 140*b* have an opening 144 extending through both the portions 142*a* and 142*b*. A protrusion 146*b* extends from the tubular portions 142*a* and 142*b*. This protrusion 146*b* cooperates with the inner lumen 127*a* of the upper member 120*a*. Extending from this protrusion 146*b* are one or more securing structures 148*b*. Each of the securing structures 148*b* can mate with a respective hole 129*b* in the upper member 120*a* when the protrusion 146*b* is disposed within the inner lumen 127*a*. These securing structures 148*b* interference fit with one or both of the upper member 120*a* and the hole 129*b*. By so doing, securing structures 148*b* securely retains the end bracket 140*b* to the upper member 120*a*. These securing structures 148*b* can optionally be biased so that they extend outwardly from protrusion 146*b*.

In addition to securing structures 148*b*, the end bracket 140*b* includes two sealing structures 150*b*. Although two sealing structures 150*b* are illustrated, one skilled in the art will appreciate that each end bracket 140*b* can include one or more sealing structures 150*b*. The sealing structures 150*b* extend around the protrusion 146*b*. Upon positioning the protrusion 146*b* within the inner lumen 127*a*, the sealing structures 150*b* contact the interior surface of the panel 120 and seal the inner lumen 127*a* from the exterior of the panel 120. In this manner, sealing structures 150*b* prevent debris and water from entering into the interior lumen 127*a*. In the illustrated configuration, the sealing structures 150*b* are integrally formed with the protrusion 146*b* and are flexible or may at least partially deform upon disposing the protrusion 146*b* within the inner lumen 127*a*. This partial deformation creates the seal between the protrusion 146*b* and the inner lumen 127*a*. In another configuration, each sealing structure 150*b* is a separate seal that mounts to the protrusion 146*b*, such as upon an exterior surface of the protrusion 146*b* or within a channel or groove formed in the protrusion 146*b*. In such a case, each sealing structure 150*b* can be, but is not limited to, an O-ring, a U-cup, a static seal, a radial squeeze seal, gaskets, or other seals capable of preventing fluid or debris entering into inner lumen 127*a*.

Still other configurations of the end bracket 140 and 140*b* are possible. In still another configuration, a plurality of structures (not shown) extends from the protrusion 146 or 146*b*, such structures being sufficiently flexible to bend or deform upon placing the protrusion 146 within the inner lumen 127*a*. The interference fit between these structures and the interior surface of the inner lumen 127*a* prevents movement of the end bracket 140 or 140*b* relative to the upper member 120*a*. In still another configuration, the protrusion 146 or 146*b* can include a biased structure (not shown) that cooperates with a hole formed in the panel 120 such that placing of the protrusion 146 or 146*b* within the inner lumen 127*a* of the upper member 120*a* causes mating engagement of the structure and the hole. This engagement prevents movement of the end bracket 140 or 140*b* relative to the panel 120 until the biasing force is released, such as by pressing upon the structure through the hole. In still another configuration, the fastener is removable so that each panel 120, and more specifically each upper or lower member 120*a* and 120*b*, may receive either an end bracket 140 or end cap 141 as desired. By using various types of structures or fasteners to aid in positioning the end bracket 140 or end cap 141 in cooperation with the panel 120, the end caps 141 and end brackets 140 can be replaced when they become damaged or when a particular panel 120 requires a different combination of end caps 141 or end brackets 140.

In still another configuration, any type of mechanical fastener, such as, but not limited to, nails, screws, bolts, rivets, etc., can attach the end bracket 140 or 140*b* to the panel 120. Alternately, or in addition to mechanical fasteners, various types of adhesives or epoxies can be used to attach the end bracket 140 or 140*b* to the panel 120 of the form 102.

Although the following discussion will be directed toward the end bracket 140, one skilled in the art will understand that the discussion also applies to the end bracket 140*b*. The above discussion has focused upon the end bracket 140 attaching to the upper member 120*a*. It will be understood, however, that the end bracket 140 can attach to the lower member 120*b* in a similar fashion. Additionally, the end bracket 140 can attach to both the upper member 120*a* and the lower member 120*b*, such as when the end bracket 140 has an upper bracket and a lower bracket, with both of these brackets having generally the same configuration as that discussed with respect to the end bracket 140.

To aid with connecting adjacent forms 102, the end bracket 140 mounted to the distal end 124 (FIG. 1) of the panel 120 is mounted to the lower member 120*b*. The end bracket 140 at the distal end 124 (FIG. 1) then can have a similar configuration to the end bracket 140 mounted to the proximal end 122. This allows for easy, quick joining of multiple forms 102 in multiple angular orientations. In another configuration, the system 100 can include one or more forms 102 that include the panel 120 having both end brackets 140 fitted onto the ends 122, 124 in the same orientation. For instance, in one configuration, both end brackets 140 are in an upward position, while in another configuration both end brackets 140 are in a downward position.

As mentioned above, an opening 144 passes through the upper portion 142*a* and the lower portion 142*b* of the end bracket 140. These openings 144 receive the stakes 170 (FIG. 1). This stake 170 may pass through the openings 144 in adjacent forms when the form 102 having the end bracket 140 attached to the lower member 120*b* is placed end to end with another form 102 that has the end bracket 140 on the upper member 120*a*, as shown in FIG. 1. The stake 170 can also be driven into the ground to hold the forms 102 in alignment while the concrete or other material is deposited in the space defined by the system 100. Other structures having sufficient strength and rigidity to prevent one form 102 moving away from another adjacent form 102 with the structure disposed with the opening 144 of adjacent forms 102 are possible.

The opening 144 can have various configurations so long as it can cooperate with stake 170 or other structure that can be disposed therein. In combination with the gap 147 formed between the upper portion 142*a* and the lower portion 142*b*, opening 144 and the gap 147 provide a path for debris to exit from the end bracket 140. By so doing, debris will not prevent adjacent forms 102 being connected together through use of the stake 170 (FIG. 1) or other structure disposed through opening 144 and/or gap 147.

Returning to FIG. 2A, the end brackets 140 allow adjacent forms 102 to be easily joined together and the relative position of adjacent forms 102 to be quickly and easily changed. The end brackets 140 can be made from a wide range of materials, including, but not limited to, various metals or metal alloys, plastics, polymers, composites, fiberglass, synthetic materials, natural materials, manufactured materials, composite materials, or other materials having the desired strength and rigidity. In one exemplary embodiment of the system 100, the end brackets 140 are metal, sized and configured to slip easily inside or over the end 122, 124 of the panel 120.

In addition to allowing debris to exit from opening 144, the gap 147 provides a space through which a fastener, such as, but not limited to, a nail, screw, or the like, may pass to engage with the stake 170 (FIG. 1). This allows the user to position the form 102 at varying heights upon the stake 170 (FIG. 1) and to level the form 102. Further, the fastener can extend into the space defined by the multiple forms 102 of the system 100 (FIG. 1) to provide a guide or marker indicating the grade of the concrete or material that is poured into the space. The user can use the fastener to level or grade the concrete or material. Alternatively, the user can use the top of the forms 102 of the system 100 (FIG. 1) to level or grade the concrete or material poured into the space defined by the system 100 (FIG. 1).

Various other configurations of the end bracket 140 are possible. For instance, in another configuration each end bracket 140 can have a first portion having a first outside diameter (not shown) and a second portion having a second outside diameter (not shown) lesser than the first diameter. The first portion may have an inside diameter that is complementary to the second portion so that a first portion of the end bracket 140 on one form 102 can receive the second portion of the end bracket 140 on an adjacent form 102. In this manner, adjacent forms 102 interference fit together. Optionally, the stake 170 can pass through the openings 144 of the upper and lower portions as adjacent forms 102 interference fit together.

In still another configuration, upper and/or lower portions may include one or more grooves that engage with complementary protrusions fashioned in the upper and/or lower portions of the end bracket 140 of an adjacent panel 120. The grooves and protrusions (not shown) engage to lock the orientation of one form 102 relative to another form 102. Depending upon the number of grooves and protrusions, one form 102 can be locked relative to another form 102 at any angular orientation. In some configurations, each tubular portion can include a locking screw that passes through one or both of the tubular portions to prevent movement of the forms 102.

In still another configuration, each opening 144 can have walls that taper from one end to the other or can have walls that are generally parallel from one end to the other. In still another configuration, each end bracket 140 includes only one of either upper portion 142*a* or lower portion 142*b*, as illustrated in FIG. 2A. In this manner, each upper member 120*a* and lower member 120*b* includes an end bracket 140 having one of upper portion 142*a* or lower portion 142*b*. One form having two end brackets 140 at one end that have upper portions 142*a* can mate or mesh with another form 102 having two end brackets 140 that have lower portion 142*b*. Although reference is made to one end having two end brackets 140 having the same upper and lower portion, one skilled in the art will understand that each end of the form 102 can have one end bracket 140 having an upper portion 142*a* and one end bracket 140 having a lower portion 142*b*.

In still another configuration, the one or more apertures 148 receive a threaded member that receives one or more threaded fasteners. For instance, the threaded member can have a threaded portion to enable the threaded member to threadably engage with the protrusion 146. An internal threaded portion of the threaded member can receives either a single threaded fasteners that passes through one of surfaces 130 and 132 or two threaded fasteners, one passing through surface 130 to threadably engage with the internal threaded portion and one passing through surface 132 to threadably engage with the internal threaded portion. In still another configuration, the threaded member is mounted to the protrusion 146 during manufacture of the end bracket 140, such as when the end bracket 140 is molded.

Returning to FIG. 2A, to protect a portion of the proximal end 122 of the panel 120, an end cap 141 cooperates with the lower member 120*b*. Similarly, to protect a portion of the distal end 124 of the panel 120, the end cap 141 cooperates with the upper member 120*a*. These end caps 141 prevent debris from entering into respective interior lumens 127*a* and 127*b* of upper member 120*a* and lower member 120*b*. Further, the end caps 141 provide a generally planar surface upon which a portion of the end bracket 140 can optionally slide when positioning adjacent forms 102. The end cap 141, as shown in FIG. 2A, has a planar member 143 with a protrusion 145 extending therefrom. The protrusion 145 has a similar configuration to the protrusion 146 of the end bracket 140 and may be attached to the form 102 (FIG. 1) in a similar manner. Similarly, end cap 141*b* of FIG. 2B can have a protrusion similar to protrusion 146*b* of bracket 140*b*. The planar member 143 of either end cap 141 or 141*b* is configured to abut the end of respective upper member 120*a* and/or lower member 120*b* and prevent debris from entering into an interior of the upper member 120*a* and the lower member 120*b*.

The end cap 141 or 141*b* can be made from a wide range of materials, including, but not limited to, various metals or metal alloys, plastics, polymers, composites, fiberglass, synthetic materials, natural materials, manufactured materials, composite materials, or other materials having the desired strength and rigidity. In one exemplary embodiment of the system 100, the end cap 141 or 141*b* is metal, sized and configured to slip easily inside the interior lumen 127*a*, 127*b* of the panel 120. The end cap 141 or 141*b* can optionally have a completely or partially closed end section to fit flush with the ends 122, 124 of the panel 120.

Generally, the forms 102, 104 of the present invention can use a variety of different combinations of end cap 141 and end bracket 140 depending upon the particular desires of the user of the system 100. As shown in FIGS. 1, 2, 3, 4, and 6, an end of each panel 120 can include two end caps 141, two end brackets 140, or a combination of one end cap 141 and one end bracket 140. Each end 122, 124 of the panel 120 can include the same combination of end caps 141 and end brackets 140 or different combinations thereof.

As discussed above, the form 104 can cooperate with the forms 102. With continued reference to FIG. 3, the form 104 may include the panel 120, with the upper member 120*a* and the lower member 120*b*, having a bulkhead bracket 150 mounted to either end of the panel 120. The form 104 can be disposed between two spaced apart forms 102 to define the end limit of the space that receives the concrete or other material. In the exemplary configuration, the form 104 defines the end of a concrete footing.

Generally, the form 104 can be located at any position along the length of forms 102 to enable the length of a footing or other structure to be changed by simply moving the location of the bulkhead form 104. Thus, the length of the footing or other structure is not limited by the length of the forms 102. Hence, the bulkhead form 104 in combination with the forms 102 can define any sized space that receives concrete or other materials. The changes in length of the footing, for example, resulting from placing the bulkhead form 104 relative to the form 102 are possible without physically changing the length of each form 102, 104.

Figure 3:
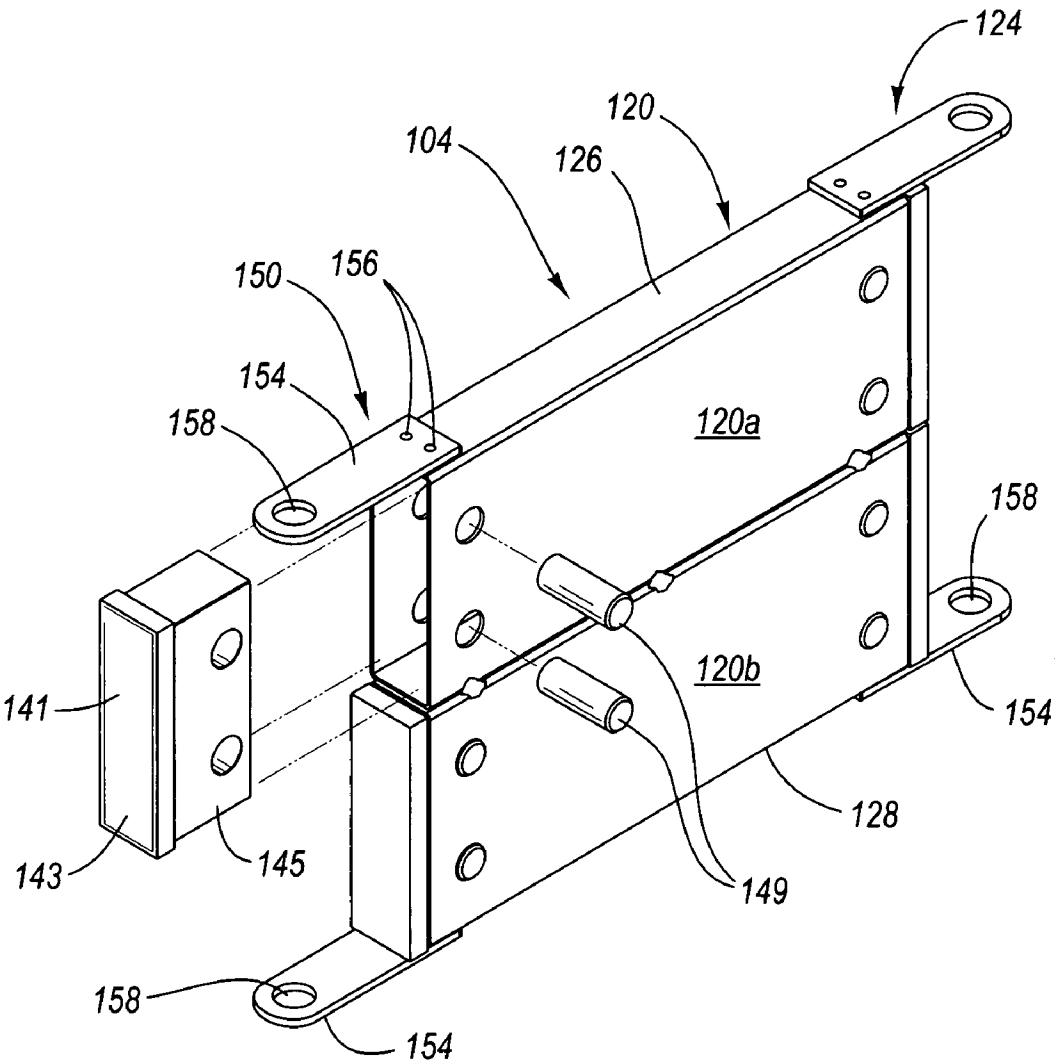
FIG. 3 is a perspective view of a portion of the system shown in FIG. 1, illustrating a bulkhead bracket.

The following discussion is directed to the bulkhead bracket 150 mounted to the end 122. It is understood that a similar discussion can be provided for the bulkhead bracket 150 mounted to the end 124. As shown in FIG. 3, the bulkhead bracket 150 can have two flange members 154, one mounted to the top surface 126 and one mounted the bottom surface 128 of the panel 120. The flange members 154 can either be directly attached to the top surface 126 and the bottom surface 128 by way of one or more fasteners (not shown) passing through one or more fastener holes 156, such mechanical fasteners including but not limited to, nails, screws, bolts, rivets, etc. Alternately, or in addition to mechanical fasteners, various types of adhesives or epoxies can be used to attach the flange members 154 to the panel 120. Further, each flange member 154 can include one or more protruding structures that attach to the panel 120 as the end bracket 150 is attached to the panel 120. Alternatively, the flange members 154 can be welded, brazed or otherwise attached to the panel 120.

Optionally forming part of the bulkhead bracket 150 are one or more end caps 141. These end caps 141 have the same structure and perform the same function as the end caps described with respect to the form 102, such as the end caps 141 or 141*b*. The end caps 141, therefore, aid in preventing debris from entering into the interior of the upper member 120*a* and the lower member 120*b*. Additionally, the planar member 143 provides a uniform surface to contact the forms 102 during use of the form 104.

Figure 4:
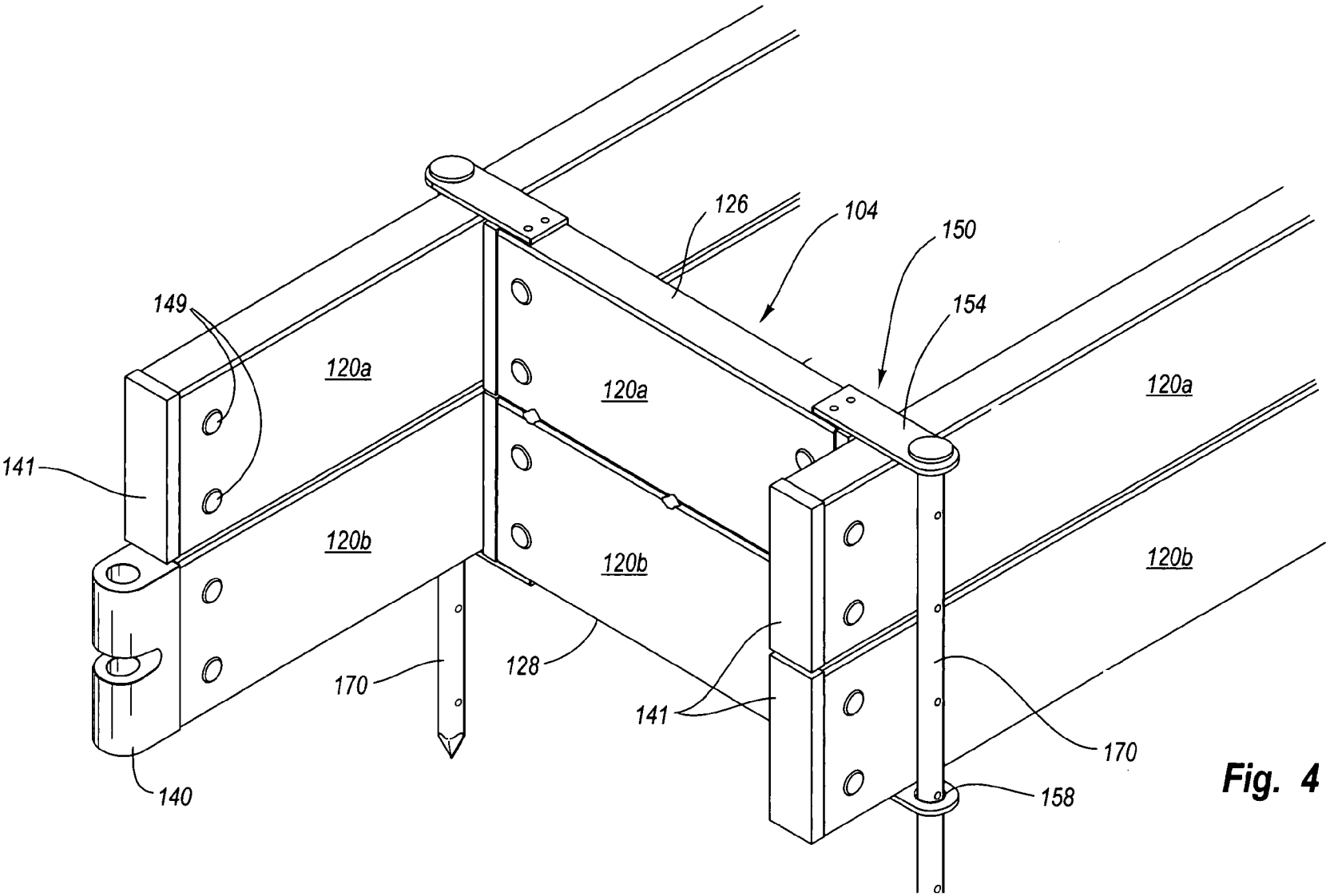
FIG. 4 is perspective view of portion of the system shown in FIG. 3 in one exemplary operational position.

As mentioned above, the flange members 154 may protrude from the panel 120. In one configuration, the flange members 154 are symmetrical, so that the panel 120 with the bulkhead bracket 150 has no top or bottom, although those skilled in the art will realize that this need not be the case. Each flange member 154 may contain at least one hole 158 that receives the stake 170, as shown in FIG. 4. By placing the holes 158 in the flange members 154 so that the panel 120 can be disposed between a portion of the holes 158 and the end of the panel 120 and the optional one or more end caps 141, the form 104 can be disposed between two forms 102. The stakes 170 prevent movement of the bulkhead form 104 longitudinally along the forms 102, while also limiting lateral movement.

When assembling the system 100, a lengthwise gap may be created between adjacent forms 102, as shown in FIG. 1. This occurs because the openings 144 (FIG. 2) in the end brackets 140 do not align. The system 100 can include the skin panel 106, as illustrated in FIGS. 5 and 6, to bridge this gap between the forms 102.

Figure 5:
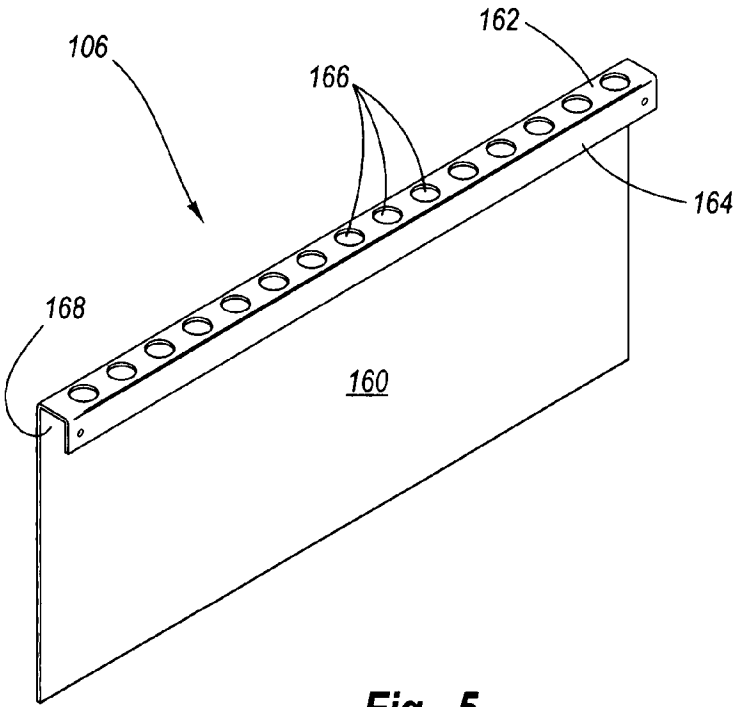
FIG. 5 is a perspective view of a portion of the system shown in FIG. 1, illustrating a skin panel.

With reference to FIG. 5, the skin panel 106 may have a first portion 160 and a second portion 164 that is separated from the first portion 160 by an intermediate portion 162. The separation between the first portion 160 and the second portion 164 provided by the intermediate portion 162 defines a channel 168. This channel 168 may be sufficient to enable placement of the skin panel 106 over at least a portion of two adjacent forms 102. More specifically, the panel 120 can be located within the channel 168 of the skin panel 106.

Generally, the skin panel 106 may be fabricated from a unitary piece of metal or metal alloy. Those skilled in the art will realize that other materials can also be used to form the skin panel 106, such as, but not limited to, plastics, wood and/or wood products, composites, combinations thereof, or other materials having the desired strength and rigidity. Although reference is made to the skin panel 106 being fabricated from a unitary piece of a material, alternate configurations of the present invention can utilize a modular construction where the first portion 160, the second portion 164, and/or the intermediate portion 162 interference fit together through complementary structures in the first portion 160, the second portion 164, and/or the intermediate portion 162. Alternately, the second portion 164, and/or the intermediate portion 162 can fit together, whether alone or through the use of mechanical fasteners, welds, adhesives, or other techniques for joining two or more members.

Figure 6:
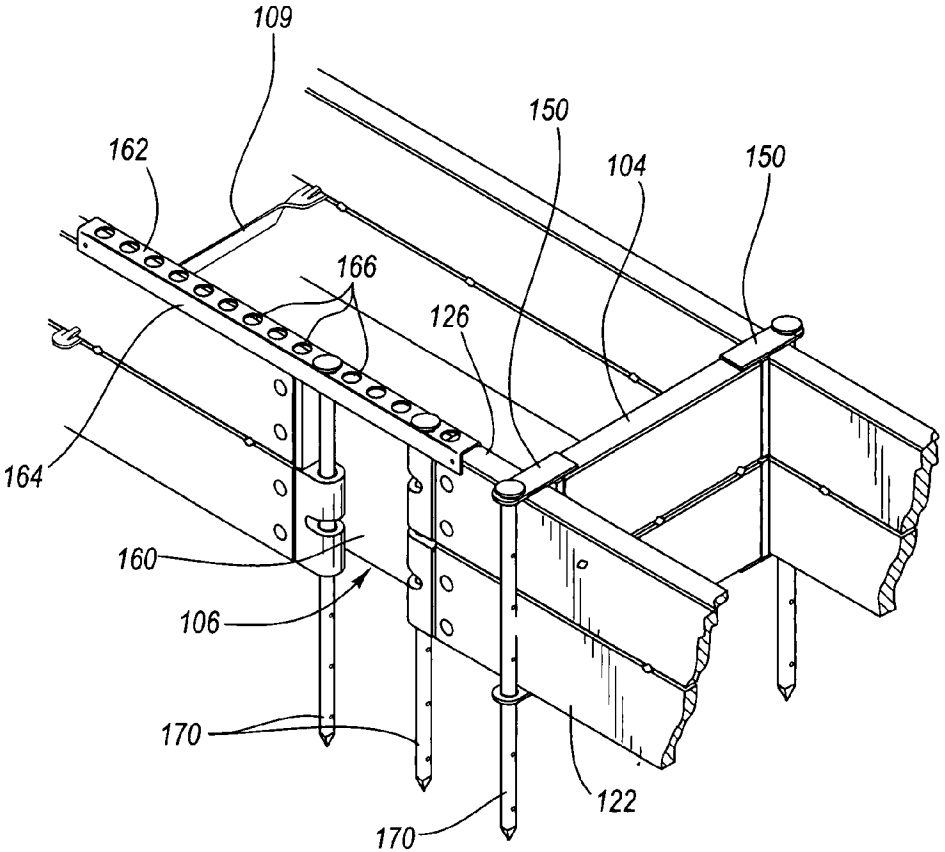
FIG. 6 is a perspective view of the skin panel of FIG. 5 in one exemplary operational position.

With reference to FIG. 6, the first portion 160 of the skin panel 106 may be placed adjacent the inside surface 130 of the panel 120 of the form 102. The channel 168 may receive the panel 120 so that the top surface 126 may contact or be close to the intermediate portion 162. One or more holes 166 in the intermediate portion 162 can receive one or more stakes 170. These stakes 170 pass through the holes 166 and the openings 144 (FIG. 2) when they align. If desired, the stakes 170 can be driven into the ground to secure the forms 102 in place and to provide structural support when concrete or other material is poured into the space defined by the system 100.

In one configuration, the skin panel 106 can be twenty-four inches long. Those skilled in the art will realize that other shorter and longer lengths are possible. Such shorter and longer lengths fall within the scope of the exemplary configuration of the system 100.

With reference to FIG. 1, as the system 100 is assembled, a whaler bracket 108 may be used to brace spaced-apart forms 102 to ensure a uniform separation between the forms 102. Uniform separation of the forms 102 results in the width of the concrete or material deposited between the forms 102 and 104 being uniform. In one configuration, the whaler bracket 108 is made from angle iron, or other metals or metal alloys. Those skilled in the art will realize that other materials can be used, including plastics, polymers, synthetic materials, natural materials, manufactured materials, composites, etc.

Figure 7:
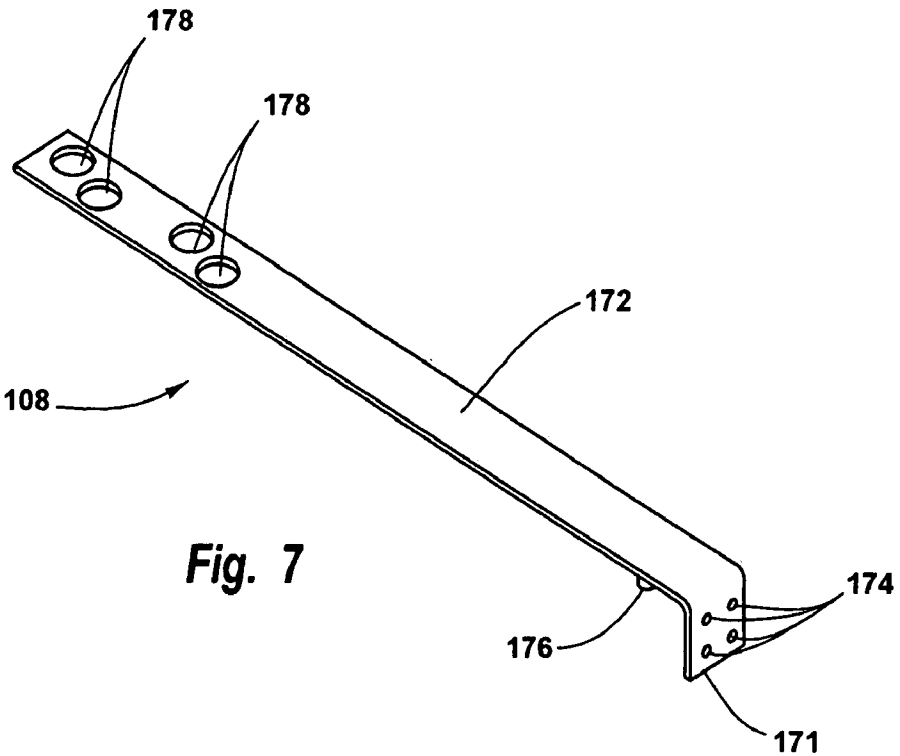
FIG. 7 is a perspective view of a portion of the system shown in FIG. 1, illustrating a whaler bracket.

With reference to FIG. 7, the whaler bracket 108 can have a generally L-shaped configuration, with a first portion 171 and a second portion 172 that can be generally perpendicular to the first portion 171. Although reference is made to the first portion 1710 and the second portion 172 being generally perpendicular one to another, one skilled in the art will understand that other angular orientations of first portion 1710 to second portion 172 are possible. Similarly, even though reference is made to the whaler bracket 108 being generally L-shaped, one skilled in the art will understand that other configurations of the whaler bracket 108 are possible. For instance, the whaler bracket 108 can be J-shaped, planaer, curved, polygonal, or any other shape.

Disposed in the first portion 171 of the whaler bracket 108 are fastener holes 174 that can accommodate any type of mechanical fastener, such as, but not limited to, nails, screws, bolts, rivets, etc. Extending from the second portion 172, in the same direction as the first portion 171, is an optional blocking pin 176. This blocking pin 176 contacts the inside surface 130 (FIG. 2) of the panel 120 to assist in fixing the whaler bracket 108 in place. It is understood, however, that other configurations of the whaler bracket 108 need not include the blocking pin 176.

In another configuration, the functionality provided by the blocking pin 176 can be provided through punching a tab or other structure from the second portion 172. In still another configuration, a portion of the second portion 172 can be stamped to create a dimple or portion protruding from the second portion 172; this protruding portion functioning to assist in fixing the whaler bracket 108 in place. Various other manners are known to those skilled in the art to perform this function.

In addition to the exemplary configuration of the whaler bracket 108 including the blocking pin 176 on the second portion 172, one or more stake holes 178 can be located through the second portion 172. Multiple stake holes 178 allow the whaler bracket 108 to be placed at various positions to ensure uniform spacing of spaced apart forms 102.

It is occasionally desired to pour vertical or angled concrete structures, such as footings, as well as horizontal footings or structures. Such a need arises, for example, when the footings need to conform to ground that is uneven. The system 100 may accommodate this need with a vertical panel 110, shown in FIG. 8. In one configuration, the vertical panel 110 is fabricated from metal or metal alloys. Those skilled in the art will realize that other materials are also possible, including, but not limited to, polymers, synthetic materials, natural materials, manufactured materials, composite materials, or other materials having the desired strength and rigidity.

Figure 8:
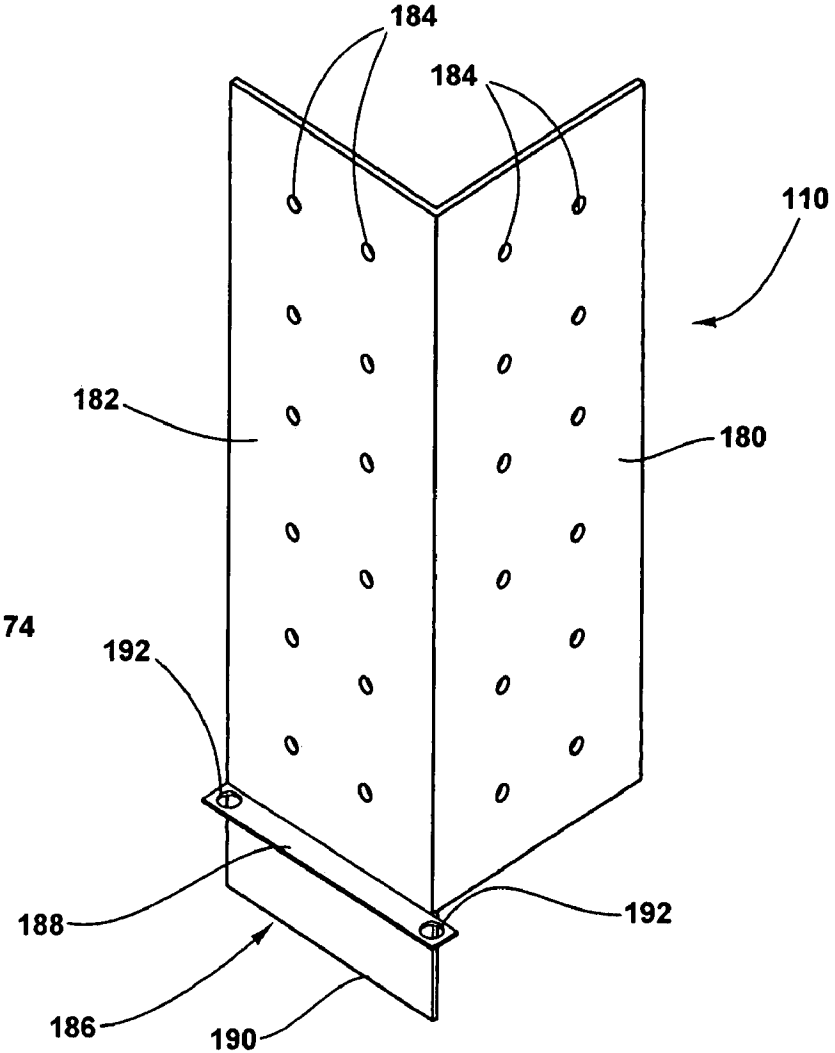
FIG. 8 is a perspective view of a portion of the system shown in FIG. 1, illustrating a vertical form.

With reference to FIG. 8, a single vertical panel 110 is shown. However, with reference to FIG. 1, the vertical panel 110 can be used as a pair of panels that form three or four closed sides, with a fifth side being the uneven ground discussed above and the sixth side being open to receive the concrete or other material poured into the space defined by the two vertical panels 110. The vertical panel 110 can include a first panel member 180 and a second panel member 182. The panel members 180 and 182 are disposed generally perpendicular one to another. Although reference is made to the first panel member 180 and the second panel member 182 being generally perpendicular one to another, one skilled in the art will understand that other angular orientations of the first panel member 180 to the second panel member 182 are possible.

Disposed in the first panel member 180 and the second panel member 182 are a plurality of fastener holes 184. The fastener holes 184 can accommodate any type of mechanical fastener, such as, but not limited to, nails, screws, bolts, rivets, etc. The fastener holes 184 allow additional structural reinforcements to be attached to the vertical panel 110, such as when the vertical panel 110 is used to abut uneven ground at an angle. These additional reinforcements can be attached on either an inside or an outside surface of the vertical panel 110 and can be fabricated from wood, plastic, metal, composites, or any other suitable material that provides the desired reinforcement properties or characteristics.

In the exemplary configuration of the vertical panel 110 shown in FIG. 8, the vertical panel 110 can include a mounting member 186 attached to the second panel member 182. However, the mounting member 186 can optionally be attached to the first panel member 180. This mounting member 186 can include a stop 188 and a positioning member 190. The stop 188 can include a plurality of holes 192 that can receive the stakes 170 (FIG. 1). The stop 188 of one of the vertical panels 110 illustrated in FIG. 1 contacts a portion of the form 102 to both support the vertical panel 110 and prevent the vertical panel 110 from moving toward the bottom surface of the form 102. Another one of the vertical panels 110 illustrated in FIG. 1 contacts a portion of another one of the forms 102. In both cases, the stop 188 can rest upon the top surface 126 (FIG. 1) of the panel 120.

Similarly, the positioning member 190 of each vertical panel 110 abuts one of the vertical surfaces of the form 102 or 104, and more specifically the panel 120, to prevent the vertical panel 110 from shifting when the concrete or other material is deposited into the space defined by the forms 102, 104 and panels 110, 120. To aid with preventing movement of the vertical panel 110, the stakes 170 pass through the holes 192 and through holes formed in optional tie 194 (FIG. 1), which extends between the two vertical panels 110, to be driven into the ground or surface upon which the system 100 is disposed. This tie 194 also partially extends along a surface of vertical panels 110 to prevent movement of the vertical panels 110 during pouring or depositing of the concrete or other material into the space defined by the vertical panels 110 and other forms 102, 104 or panels 110, 120 of the system 100.

Generally, the vertical panel 110, with the panel members 180, 182 and the mounting member 186 can be fabricated from a unitary piece of a material or from multiple pieces attached or joined together. Attaching or joining multiple pieces of material can occur through use of mechanical fasteners, welds, adhesives, or other techniques for joining two or more members together. In this configuration, the vertical panel 110 is made from metal, however, the vertical panel 110 can be fabricated from wood, plastic, metal, alloy, composites, or any other suitable material that provides the desired strength and rigidity.

Figure 9A:
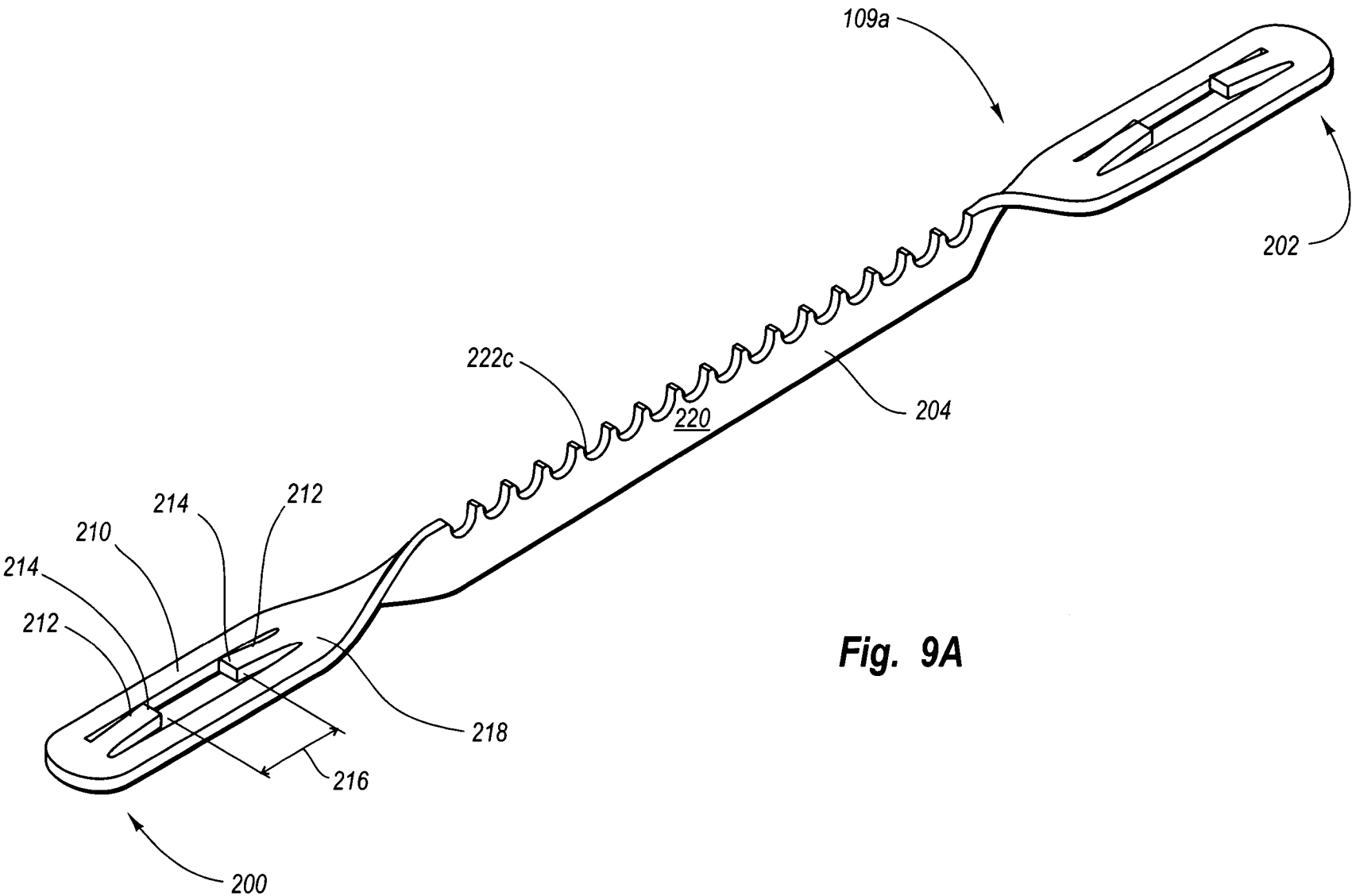
FIG. 9A is a perspective view of a tie of the present invention.
Figure 9B:
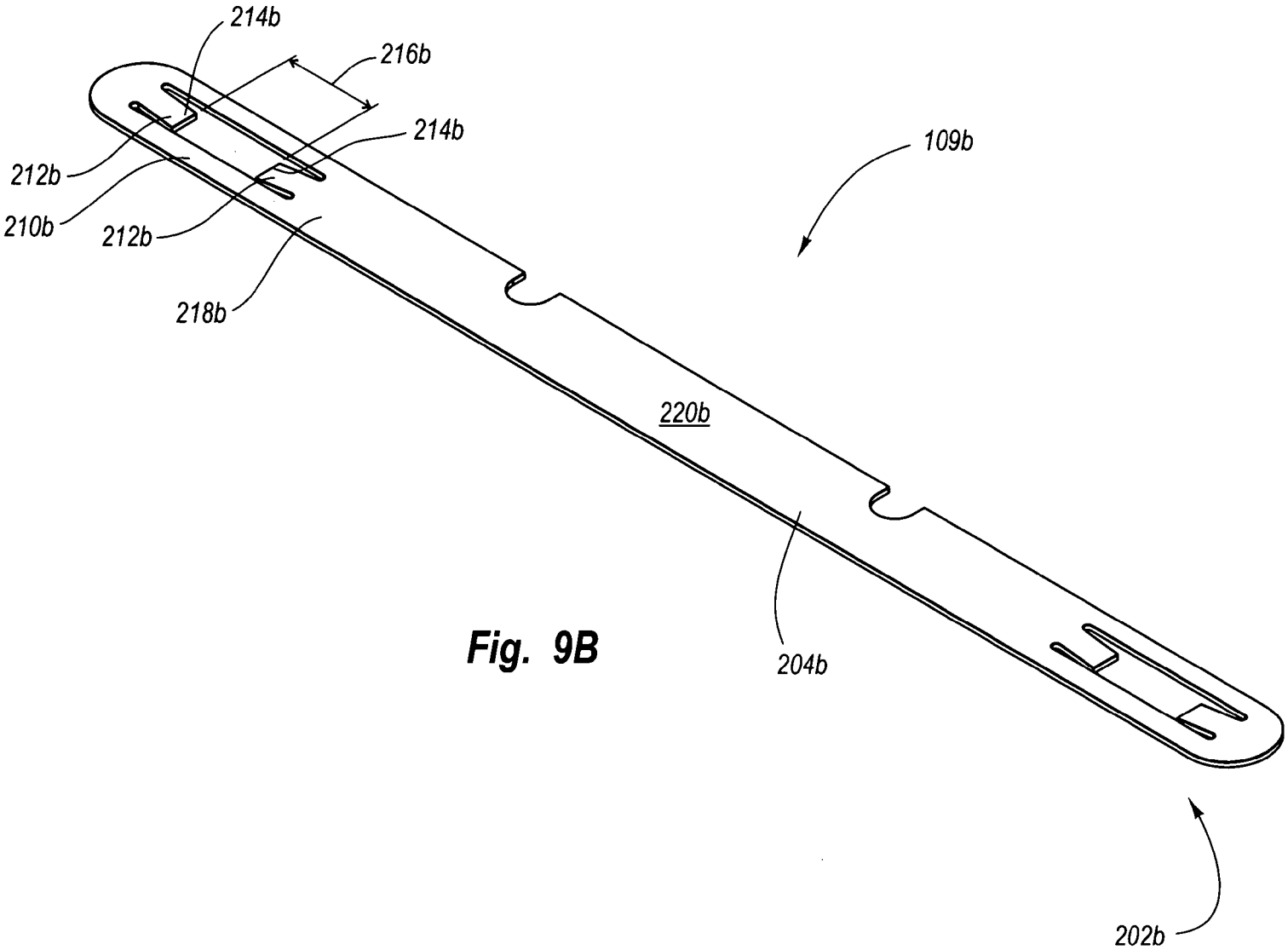
FIG. 9B is a perspective view of an alternate tie of the present invention.
Figure 9C:
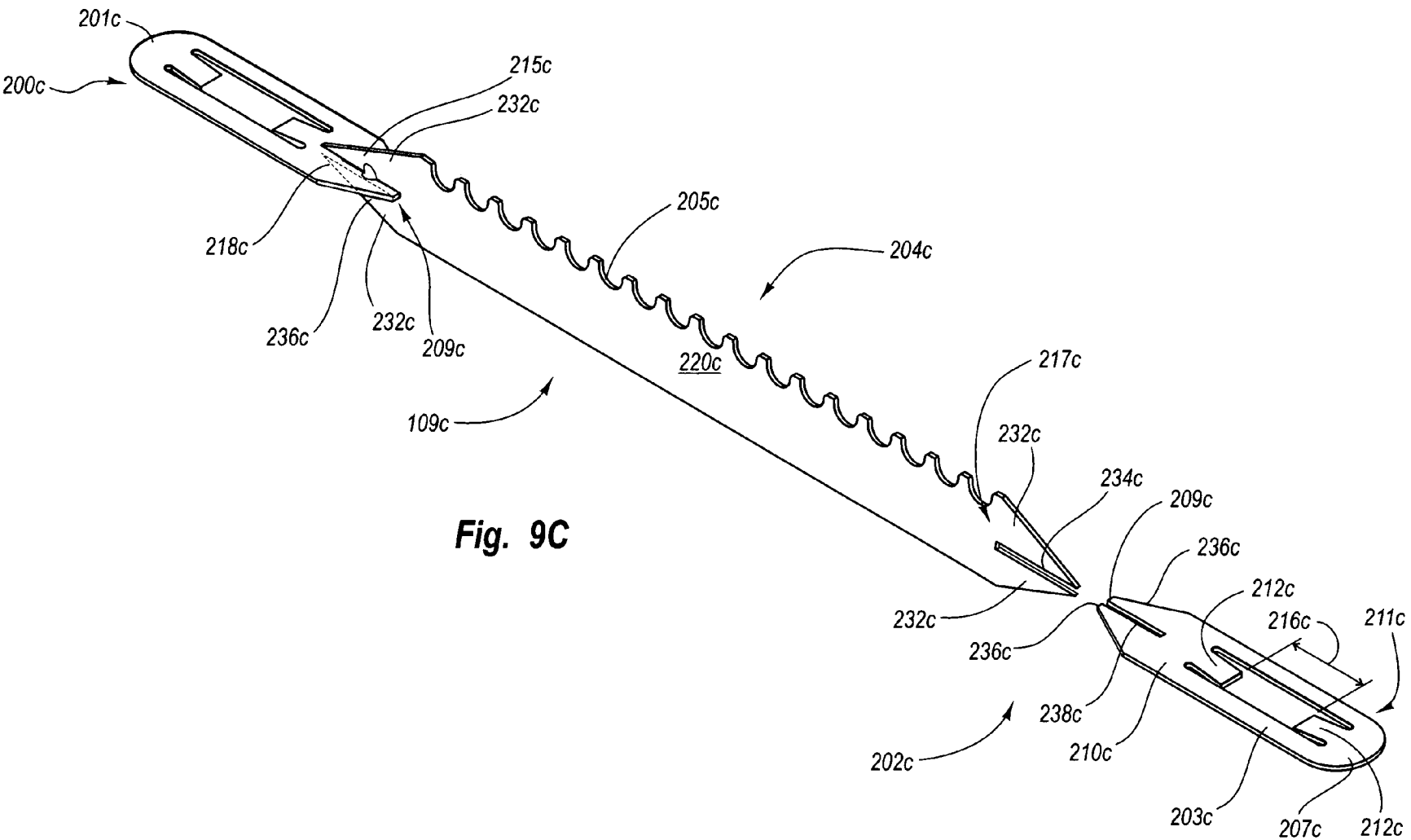
FIG. 9C is a perspective view of another alternate tie of the present invention.

In addition to the use of the whaler bracket 108 to separate adjacent forms 102, the system 100 can utilize one or more ties 109*a*, 109*b*, and 109*c*, exemplary configurations of which are illustrated in FIGS. 9A-9C. The following discussion will be directed to the tie 109*a*, however, the general discussion also applies to ties 109*b* and 109*c*. The tie 109*a* has a proximal end 200 separated from a distal end 202 by an intermediate portion 204. Each end 200 and 202 is configured to enable the tie 109*a* to at least partially pass through channel 123 and lock to the panel 120. Alternatively, the tie 109*a* can mount to a top or bottom surface of two adjacent forms 102, rather than being disposed in channel 123. In either case, each end 200 and 202 has a generally planar portion 210 with, in this exemplary configuration, two protrusions 212 extending from the planar portion 210. It will be understood that in other configurations, each planar portion 210 can include one or more protrusions.

Figure 10:
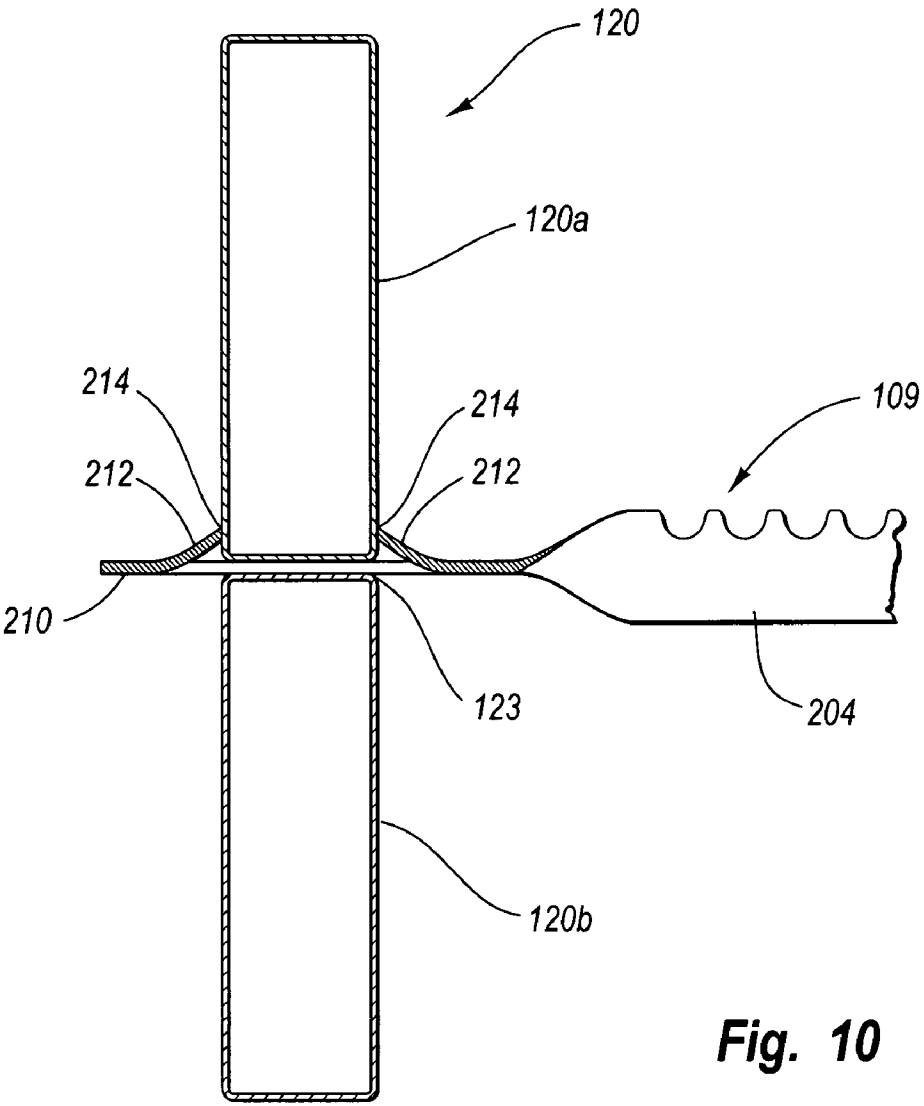
FIG. 10 is a cross-sectional side view of the tie mounted to a form of the system of FIG. 1.

The planar portion 210 is configured to be disposed within the channel 123. The protrusions 212 are biased so that positioning the planar portion 210 within channel 123 moves an end 214 of the protrusion 212 toward the planar portion 210. A gap 216 formed between the ends 214 of the protrusions 212 is sufficiently large to receive a portion of either the upper member 120*a* or the lower member 120*b*. By so doing, as the planar portion 210 advances through the channel 123, the biasing action of the protrusions 212 results in the ends 214 returning to substantially the some starting position with either the upper member 120*a* or the lower member 120*b* disposed therebetween, as shown in FIG. 10.

Although discussion has been made to the use of the protrusion 212 to help maintain the tie 109*a* within the channel 123, other structures may be used. For instance, in another configuration a hole can be substituted for the protrusion. With the tie 109*a* being sufficiently long that the hole of the tie 109*a* is external to the space defined by the forms 102, 104 of the system 100 (FIG. 1), the stake 170 (FIG. 1) can pass through the hole and be driven into the ground to prevent unwanted movement of the tie 109*a*. Various other configurations are possible.

Returning to FIG. 9A, the intermediate portion 204 provides strength and stability to the tie 109*a*. A first surface 220 of the intermediate portion 204 is generally perpendicular to a first surface 218 of the planar portion 210. In this configuration, the intermediate portion 204 flexes less than would occur if the first surface 220 was parallel to the first surface 218 of the planar portion 210. The tie 109*a*, therefore, has sufficient rigidity to maintain the separation of adjacent forms 102 when the first end 200 attaches to a first form 102 and the second end 202 attaches to a second form 102 spaced apart from the first form 102. The intermediate portion 204 includes a plurality of recesses 222*c* that are configured to receive re-bar or other components that are used to provide strength to the concrete structure. More generally, the plurality of recesses 222*c* can support any other component or structure that is to be embedded in the completed concrete structure. Although the recesses 222*c* are illustrated as being uniform, one skilled in the art can appreciate that a variety of differently sized recesses 222*c* can be incorporated in each tie 109*a* to accommodate variously sized structural components.

The intermediate portion 204 can have various other configurations to perform the identified function. For instance, the first surface 220 can be parallel to the first surface 218 of the planar portion 210, with additional webs, support structures, or strengthening structures that reduce the flexing of the intermediate portion 204 and so the tie 109*a*. Alternatively, the first surface 220 can be parallel to the first surface 218 of the planar portion 210, as is illustrated with respect to tie 109*b* of FIG. 9B, with the first surface 220*b* being parallel to the first surface 218*b* of the planar portion 210*b*.

Another configuration of the tie is illustrated in FIG. 9C, and identified by reference numeral 109*c*. Tie 109*c* includes a proximal end 200*c* separated from a distal end 202*c* by an intermediate portion 204*c*. Ends 200*c* and 202*c* are similar in appearance and structure to ends 200 and 202 discussed above. Each end 200*c* and 202*c* is configured to enable the tie 109*c* to at least partially pass through channel 123 (FIG. 1) and lock to the panel 120. Alternatively, the tie 109*c* can mount to a top or bottom surface of two adjacent forms 102, rather than being disposed in channel 123 (FIG. 1).

As shown, tie 109*c* includes a first member 201*c*, a second member 203*c*, and an intermediate member 205*c*. Members 201*c* and 203*c* have generally the same configuration and mate with the intermediate member 205*c*, as will be discussed hereinafter. Discussion herein will be directed to member 203*c*. However, a similar discussion can be provided for the member 201*c*. The member 203*c* includes a first end 207*c* and a second end 209*c*. Extending from the first end 207*c* to the second end 209*c* is a generally planar portion 210*c* with two protrusions 212*c* extending from a first surface 218*c* of the planar portion 210*c*. The protrusions 212*c* are biased so that positioning the planar portion 210*c* within channel 123 (FIG. 1) moves an end of the protrusion 212*c* toward the planar portion 210*c*. A gap 216*c* formed between the ends of the protrusions 212*c* is sufficiently large to receive a portion of either the upper member 120*a* (FIG. 2) or the lower member 120*b* (FIG. 2). Although the protrusions 212*c* are illustrated as extending downward, it will be understood that in other configurations the protrusions 212*c* may extend upwardly.

Disposed at second end 209*c* are extensions 236*c* that form a slot 238*c* that extends from first end 200*c*. While extensions 236*c* are shown as having a generally triangular shape, other shapes, including but not limited to, square, polygonal, rectangular, and the like, are also contemplated to fall within the scope of the exemplary embodiments. Similarly, while extensions 236*c* are shown as being substantially symmetrical, this need not be the case.

Slot 238*c* is adapted to cooperate with the intermediate member 205*c*. More specifically, the intermediate member 205*c* includes a first end 215*c* and a second end 217*c*. Each end 215*c* and 217*c* includes extensions 232*c* that form a slot 234*c*; the slot 234*c* being complementary so that the slot 238*c* in the respective member 201*c* or 203*c* engages with the slot 238*c*, as shown at the end 202*c*. The combination of the slots 234*c* and 238*c* is a joint of the tie 109*c*.

While extensions 232*c* are shown as having a triangular shape, other shapes, including but not limited to, square, polygonal rectangular, and the like, are also contemplated to fall within the scope of the exemplary embodiments. Similarly, while extensions 232*c* are shown as being substantially symmetrical, this need not be the case. The extensions can have different shapes and still fall within the scope of the exemplary embodiments.

In this exemplary embodiment, slots 234*c* and 238*c* perpendicularly interlock, such that extensions 232*c* are positioned adjacent protrusion 212*c*, and extensions 236*c* are positioned adjacent surfaces 220*c* when the second member 203*c* and intermediate member 205*c* fit together. While the slots 234*c*, 238*c* are shown as being substantially perpendicular, this need not be the case. Any angle for joining the first member 201*c* and the second member 203*c* with the intermediate member 205*c* can be used and is contemplated to fall within the scope of the exemplary embodiments.

In one exemplary embodiment, ends 200*c*, 202*c* and intermediate portion 204*c* are made from metal. The joint formed between the first member 201*c*, the second member 203*c*, and the intermediate member 205*c* can be a welded joint. However, other methods of connecting the members 201*c*, 203*c*, and 205*c*, including, but not limited to, the use of chemical and mechanical fasteners, are also contemplated and fall within the scope of the exemplary embodiments. Additionally, while this exemplary embodiment shows two slots 234*c* and 238*c*, various other numbers of slots, including one slot on the first member 201*c*, the second member 203*c*, and/or the intermediate member 205*c* are also contemplated to fall within the scope of the exemplary embodiments.

The ties 109*a*, 109*b* and 109*c* can be made from a wide range of materials. For instance, the ties 109*a*, 109*b* and 109*c* can be fabricated from, but not limited to, various metals or metal alloys, plastics, polymers, composites, fiberglass, synthetic materials, natural materials, manufactured materials, composite materials, or other materials having the desired strength and rigidity.

Further, the ties 109*a*-109*c* can use a unitary configuration or a multiple configuration. Therefore, ties 109*a*-109*c* can be from a single piece or from multiple pieces, no matter the exemplary configuration depicted in FIGS. 9A-9C. For instance, the tie 109*a* can be fabricated from multiple pieces and the tie 109*c* can be fabricated from a unitary piece.

Returning to FIG. 1, in an exemplary configuration, the stakes 170 can be made from metal, and be about 0.75 inches in diameter. The stakes 170 can be of a sufficient length to be easily driven into the ground through holes in the various components discussed above. This provides for additional support when the concrete is poured into the forms 102. Those skilled in the art will realize that other materials, diameters, and varying lengths for the stake 170 are also possible. For example, the stake 170 can be made from plastic, wood, composites, or other suitable materials.

Figure 11:
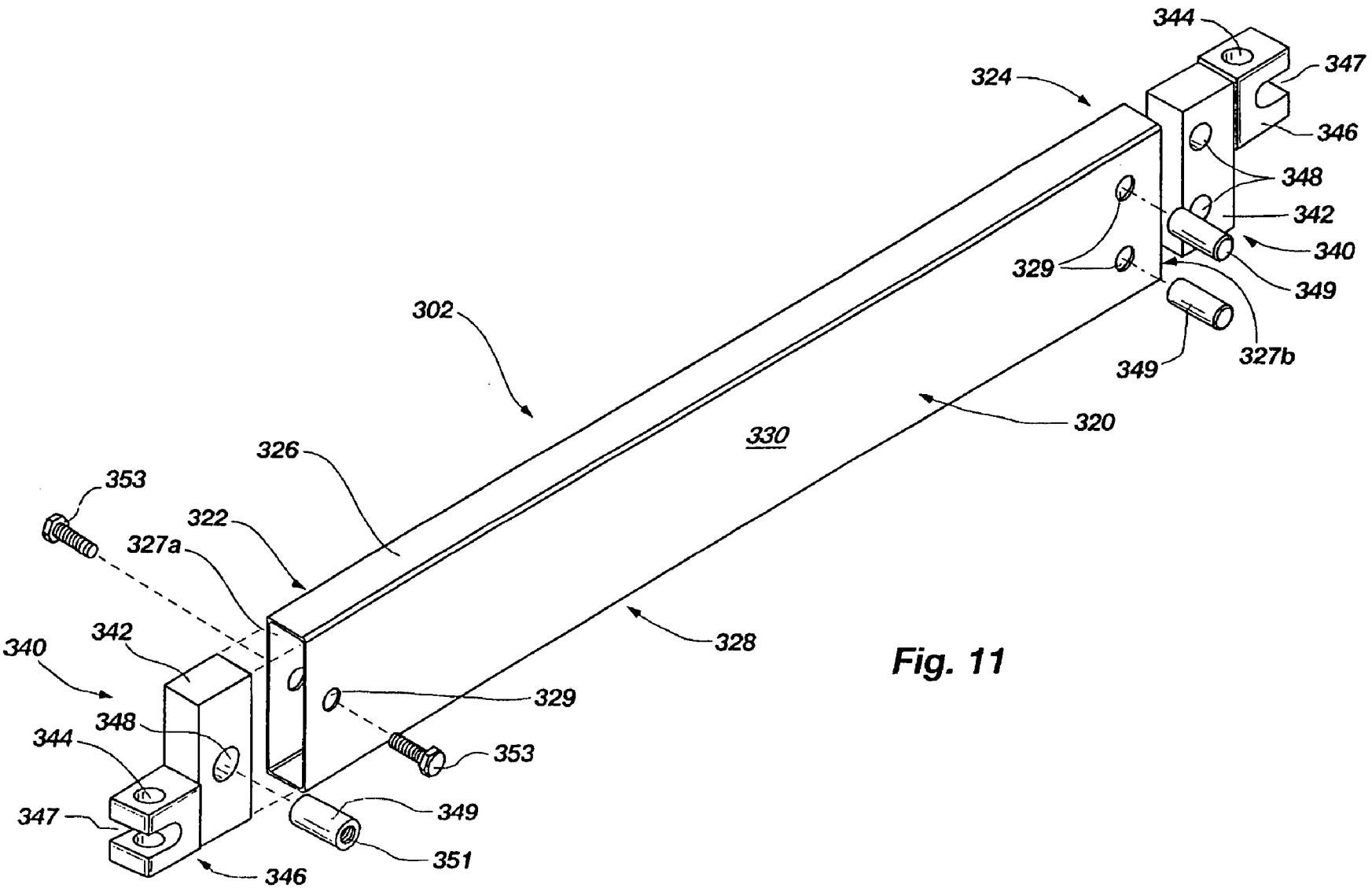
FIG. 11 is a perspective view of a portion of an alternate system, illustrating a panel and an end bracket.

Turning now to FIG. 11, illustrated is another configuration of the present invention. The exemplary embodiment of the present invention illustrated in FIG. 11 is part of a system 300 (only a portion of which is shown) that can be used to create concrete flatwork, such as sidewalks, driveways, or other generally horizontal structures. This system 300 enables generally horizontal structures to be positioned in a simple and efficient manner, and to any desired dimensions, while limiting waste of wood or other materials. The system 300 can include various forms, brackets, and panels that are used together to accommodate variations in the flatwork layout and configuration, such as those forms and brackets described herein.

The system 300 generally can include a form 302 that can be modified to different lengths based upon the configuration of the flatwork. As mentioned above, a form is a structure that defines a space within which concrete or other material is to be received. One or more forms 302 are used to create a structured layout of the space to receive the concrete or other material. The system 300 facilitates simple joining of forms 302 using simple components that allow the relative position of adjacent forms 302 to be quickly and easily changed.

Generally, system 300 has the some configuration as system 100, except that instead of utilizing a panel with an upper member and a lower member, the panel is a single tubular member, as will be described more in detail hereinafter. One skilled in the art can appreciate that the bulkhead forms, end brackets, etc. previously described can also be used with the form 302 with limited changes to the structure thereof. Hence, the description and discussion related to system 100 applies to system 300. For instance, system 300 can optionally include whaler bracket 108 (FIG. 1) that acts as a brace between two spaced apart forms 302, while maintaining a desired separation between the forms 302. The system 300 may also include one or more ties 109*a*, 109*b* and/or 109*c* (FIGS. 1 and 9A-9C) that extend between spaced apart forms 302. Further, the system 300 can include the skin panel 106 (FIG. 1) when gaps form between adjacent forms 302.

The exemplary embodiments will be described in the context of using the system 300 for creating a concrete sidewalk, patio, or other flat structure. It will be understood, however, that the exemplary embodiments can be used with other concrete structures. Generally, the system 300 is modular and can include a variety of forms, panels, brackets and end caps that can cooperate to define a desired space that receives concrete or other material.

With reference to FIG. 11, the form 302 may include the panel 320 with one or more end brackets 340 attached to opposing ends of the panel 320. FIG. 11 illustrates two end brackets 340, attached to either end of panel 320. In other configurations, the form 302 can include a single end bracket 340. The panel 320 may be generally planar and have sufficient rigidity to hold concrete or other materials in place before it cures or sets. In the illustrated configuration, the panel 320 has a proximal end 322 and a distal end 324, each of which can receive the end bracket 340. As shown, the panel 320 includes a single member which can be tubular. Alternatively, panel 320 can be substantially solid and have a recess or cavity at one or more of the ends thereof.

Extending between the proximal end 322 and the distal end 324 of the panel 320 is a top surface 326, a bottom surface 328, an inside surface 330, and an outside surface 332 (not shown on FIG. 11). These terms are specific to the orientation of form 302 illustrated in FIG. 11. It will be understood that if the form 302 is inverted, the top surface 326 may not be the "top surface", the bottom surface 328 may not be the "bottom surface", the inside surface 330 may be not the "inside surface", and the outside surface 332 may not be the "outside surface". The exemplary embodiments should not be considered limited by the use of these relative terms.

In one exemplary embodiment, each panel 320 is an aluminum tubular member with one or more holes 329, optionally counter sunk, disposed in at least one of the ends 322 and 324. Although reference is made to the panel 320 being aluminum tubular members, the panel 320 can be a wooden board. Other materials are also possible, such as plywood, plastic, pressboard, metal, alloy, high density overlaid (HDO) wood, composites, or any other material having the desired rigidity and strength, whether or not such materials are used to form a tubular structure. When the panel 320 is not a tubular member, it may include a recess or cavity that cooperates with the end bracket 340.

Each panel 320 can be fabricated from one or more sections that connect together to create the desired structure of panel 320. The panels 320 can have various cross-sectional areas or dimensions. In one configuration, the panel 320 has cross-sectional dimensions of about two inches by about twelve inches. In another configuration, the panel 320 can have cross-sectional dimensions of one and one eighth inches by eleven and one eighth inches, one and one quarter inches by eleven and seven eighth inches, or other cross-sectional dimensions depending on the type of material used to make panels 320. Similarly, each panel 320 can have various lengths, such as but not limited to, from about one foot to about twelve feet in length. It will be understood that lengths lesser than one foot and greater than twelve feet are also possible.

As shown in FIG. 11, the end bracket 340 can mount to the end 322 and be received within an interior lumen 327*a* of panel 320. The end bracket 340 can include a first portion 342 that extends the length of, and substantially fills the interior lumen 327*a*, and a second portion 346 that can extend beyond the end 322 of panel 320. In one exemplary configuration, second portion 346 can extend from the bottom surface 328 of the panel 320 toward the top surface 326 a distance that is about half the height of panel 320. In other configurations, the second portion 346 can extend towards the top surface 326 less or more than about half the height of the panel 320. To aid with connecting adjacent forms 302, the end bracket 340 mounted to the distal end 324 of the panel 320 is inverted. The end bracket 340 at the distal end 324 then can include the second portion 346 extending from the top surface 326 toward the bottom surface 328. This allows for easy, quick joining of multiple forms 302 in multiple angular orientations.

In still another configuration, the end bracket 340 can include a flange (not shown) that mounts to one or more of the top surface 326, the bottom surface 328, the inside surface 330, and/or the outside surface 332. In yet another configuration, the system 300 can include one or more forms 302 that include the panel 320 having both end brackets 340 fitted onto the ends 322, 324 in the same orientation. For instance, in one configuration, both end brackets 340 are in an upward position, while in another configuration both end brackets 340 are in a downward position.

With continued reference to FIG. 11, the first portion 342 of the end bracket 340 attaches to the end 322. To aid with attaching the first portion 342 to the panel 320, the first portion 342 can include a fastening hole 348 within which is disposed a bushing 349. The bushing 349 includes a threaded hole 351 that cooperates with one or two fasteners 353. The end bracket 340 attaches to the end 322 of the panel 320 by inserting first portion 342 into interior lumen 327*a* until the threaded hole 351 aligns with holes 329. Each threaded hole 351 can receive two fasteners 353, such as bolts, that pass through the holes 329 in the panel 320 and threadably engage with the threaded hole 351 in the first portion 342 when the first portion 342 is disposed within the inner lumen 327*a*. This fastener 353 secures the end bracket 340 to the panel 320.

Although reference is made to the fasteners 353 threadably engaging with the threaded hole 351, one skilled in the art will understand that various other techniques may be used to attach the end bracket 340 to the panel 320. For instance, in another configuration, the fastener 351 can thermally bond panel 320 and the first portion 342 of the end bracket 340. It will be understood that the first portion 342 can have similar configurations to protrusions 145*b*, 146 and 146*b* described herein. Therefore, the first portion 342 can have similar configurations to those protrusions and others described here. In another configuration, a rod similar to that described with respect to FIGS. 2A and 2B can be used. More generally, any of the methods or techniques described herein to join the bracket 340 to the panel 320 may be used.

The second portion 346 may have a hole 344 that receives the stake 170 (FIG. 1). This stake 170 may pass through the holes 344 in adjacent forms 302 when the form 302 having the second portion 346 on the bottom is placed end to end with another form 302 that has the second portion 346 on top. The stake 170 can also be driven into the ground to hold the forms 302 in alignment while the concrete or other material is deposited in the space defined by the system 300. The end of the second portion 346 can be generally planaer to aid with aligning an adjacent form 302. As the second portion 346 contacts the first portion 342, the longitudinal axes of both adjacent forms 302 are aligned. This helps maintain the alignment of a number of forms 302 over a long distance. In an alternate configuration, the end of second portion 346 can be curved, beveled, or have some other non-planar shape.

As with the brackets 140 for FIGS. 2A and 2B, the bracket 340 can include a gap 347 that functions in a similar manner to the gap 147 described herein. For instance, the gap 347 can receive a fastener, such as, but not limited to, a nail, screw, etc. that engages with a hole in the stake 170 (FIG. 1).

With continued reference to FIG. 11, the end brackets 340 allow adjacent forms 302 to be easily joined together and the relative position of adjacent forms 302 to be quickly and easily changed. The end brackets 340 can be made from a wide range of materials, including, but not limited to, various metals or metal alloys, plastics, composites, fiberglass, or other materials having the desired strength and rigidity. In one exemplary embodiment of the system 300, the end brackets 340 are metal, sized and configured to slip easily into the interior lumen 327*a* of the panel 320.

Various other configurations of the end bracket 340 are possible. For instance, in another configuration each second portion 346 can have a first part having a first outside diameter and a second part having a second outside diameter lesser than the first diameter. The first part may have an inside diameter that is complementary to the second part so that a first part of the end bracket 340 on one form 302 can receive the second part of the end bracket 340 on an adjacent form 302. In this manner, adjacent forms 302 interference fit together. Optionally, the stake 170 can pass through the holes 344 of the second portions as adjacent forms 302 interference fit together.

The systems 100 and 300 provide many advantages over the prior art. The systems 100, 300 eliminate the old way of nailing boards together, which causes weak corners, extreme wear, and splintering of the lumber. Both the end brackets 140, 340 and the bulkhead brackets 150 fit at least partially over the exposed ends of the panels 120, 320 of the forms 102, 302, thus eliminating the cracking, splitting and splintering caused by nailing, while increasing the life of the forms 102, 302 by many times that of conventional lumber forms. The systems 100, 300 also eliminate the wasting of expensive nails and lumber, since the forms 102, 302 can be reused.

The systems 100, 300 allow the connection of two forms 102, 3302 with a steel pin or stake. Once pinned together, the systems 100, 300 allow forms 102, 302 to be connected together in a straight line, ninety-degree inside and outside corners, and any corner or angle in between. This is a great improvement over prior art systems that use channels and inserts, since these prior art systems can only be joined at angles of about 90 degrees.

Using the skin panel 106, the systems 100, 300 can define a space to receive concrete or other materials of any desired dimension, regardless of the specific length of the individual forms 102, 302. Any gaps between the forms 102, 302 are bridged with the skin panel 106. Finally, the systems 100, 300 using the form 104 allow the end of the space that receives the concrete or other material to be placed any-where inside the spaced apart forms 102. This allows for a system 100 that can include a fixed number of forms 102, 104 each having a fixed length, yet still accommodates a space of any required dimension.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A concrete form system for holding concrete in a desired shaped until it cures or sets, the system comprising:

a first panel including an elongated upper member that is spaced apart from an elongated lower member, the elongated upper member including a first end, a first opening disposed at least proximate the first end, a second end and a second opening disposed at least proximate the second end, the elongated lower member including a first end, a first opening disposed at least proximate the first end, a second end and a second opening disposed at least proximate the second end;

a first elongated channel at least partially formed by the spaced apart elongated upper member and elongated lower member of the first panel;

a second panel including an elongated upper member that is spaced apart from an elongated lower member, the elongated upper member including a first end, a first opening disposed at least proximate the first end, a second end and a second opening disposed at least proximate the second end, the elongated lower member including a first end, a first opening disposed at least proximate the first end, a second end and a second opening disposed at least proximate the second end;

a second elongated channel at least partially formed by the spaced apart elongated upper member and elongated lower member of the second panel; and a tie including a first end and a second end, the first end and the second end of the tie being sized and configured to be at least partially disposed within the first elongated channel and the second elongated channel to facilitate positioning of the first panel and the second panel.

2. The concrete form system as in claim 1, further comprising a first bracket including a first end and a second end, the first end being sized and configured to be at least partially inserted into one or more of the openings in the ends of the first panel to facilitate connection of the first bracket to the first panel, the second end being sized and configured to be at least partially disposed outside the opening in the end of the first panel when the first bracket is attached to the first panel; and a second bracket including a first end and a second end, the first end being sized and configured to be at least partially inserted into one or more of the openings in the ends of the second panel to facilitate connection of the second bracket to the second panel, the second end being sized and configured to be at least partially disposed outside the opening in the end of the second panel when the second bracket is attached to the second panel.

3. The concrete form system as in claim 2, wherein the first bracket is an end bracket, the second end of the end bracket including an opening that is sized and configured to facilitate connecting the end bracket to another end bracket.

4. The concrete form system as in claim 2, wherein the opening in the end bracket is generally vertically positioned and an aperture is disposed at an angle relative to the opening.

5. The concrete form system as in claim 1, wherein the upper portion and the lower portion of the first and second panels are constructed from metal, have a generally rectangular configuration and are at least partially interconnected by welding.

6. A concrete form system for holding concrete in a desired shaped until it cures or sets, the system comprising:

one or more panels including an inner portion that is sized and configured to contact the concrete while it cures or sets, each panel of the one or more panels comprising:

an upper portion including a first end with an opening and a second end with an opening;

a lower portion including a first end with an opening and a second end with an opening; and a channel at least partially disposed between the upper portion and the lower portion of the panel;

wherein the upper portion of the one or more panels and the lower portion of the one or more panels are constructed from metal, have a generally rectangular configuration, and are at least partially interconnected by welding;

a first bracket including a first end and a second end, the first end being sized and configured to be at least partially inserted into one or more of the openings in the ends of the panel to facilitate connection of the first bracket to the panel, the second end being sized and configured to be at least partially disposed outside the opening in the end of the panel when the first bracket is attached to the panel; and a second bracket including a first end and a second end, the first end being sized and configured to be at least partially inserted into one or more of the openings in the ends of the panel to facilitate connection of the second bracket to the panel, the second end being sized and configured to be at least partially disposed outside the opening in the end of the panel when the second bracket is attached to the panel.

7. A concrete form system for holding concrete in a desired shaped until it cures or sets, the system comprising:

one or more elongated panels, each panel of the one or more elongated panels comprising:

an upper portion including a first end with an opening and a second end with an opening;

a lower portion including a first end with an opening and a second end with an opening, the upper portion and the lower portion of the panel being at least partially spaced apart; and an elongated channel at least partially disposed between the upper portion and the lower portion of the panel;

wherein the upper portion of the one or more panels and the lower portion of the one or more panels are constructed from metal, have a generally rectangular configuration, and are at least partially interconnected by welding;

a first bracket including a first end and a second end, the first end being sized and configured to be at least partially inserted into one or more of the openings in the ends of the panel to facilitate connection of the first bracket to the panel, the second end being sized and configured to be at least partially disposed outside the opening in the end of the panel when the first bracket is attached to the panel; and a second bracket including a first end and a second end, the first end being sized and configured to be at least partially inserted into one or more of the openings in the ends of the panel to facilitate connection of the second bracket to the panel, the second end being sized and configured to be at least partially disposed outside the opening in the end of the panel when the second bracket is attached to the panel.

* * * * *